US008022578B2

(12) United States Patent
Kondo

(10) Patent No.: US 8,022,578 B2
(45) Date of Patent: Sep. 20, 2011

(54) ELECTRIC POWER SUPPLY CUT-OFF CIRCUIT AND LIQUID DROPLET DISCHARGE APPARATUS

(75) Inventor: Hirofumi Kondo, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 235 days.

(21) Appl. No.: 12/147,465

(22) Filed: Jun. 26, 2008

(65) Prior Publication Data

US 2009/0001819 A1 Jan. 1, 2009

(30) Foreign Application Priority Data

Jun. 26, 2007 (JP) ..... 2007-167106

(51) Int. Cl.

| | |
|---|---|
| ***H01H 35/14*** | (2006.01) |
| ***H01H 37/00*** | (2006.01) |
| ***H01H 47/24*** | (2006.01) |
| ***H01H 47/26*** | (2006.01) |

(52) U.S. Cl. ..... 307/117; 307/116; 307/140; 361/93.8; 361/679.01; 361/679.49; 361/695; 361/697; 361/698

(58) Field of Classification Search ..... None
See application file for complete search history.

(56) References Cited

U.S. PATENT DOCUMENTS

| | | | | |
|---|---|---|---|---|
| 5,519,417 | A * | 5/1996 | Stephany et al. | 347/14 |
| 6,052,268 | A * | 4/2000 | Thomas | 361/103 |
| 6,222,158 | B1 | 4/2001 | Nakata et al. | |
| 7,290,847 | B2 | 11/2007 | Shirotori et al. | |
| 2002/0171695 | A1 * | 11/2002 | Masuda | 347/9 |
| 2004/0135834 | A1 * | 7/2004 | Gilbert et al. | 347/14 |
| 2006/0018676 | A1 * | 1/2006 | Ishii | 399/33 |
| 2007/0085521 | A1 * | 4/2007 | Nagai | 323/283 |
| 2008/0030914 | A1 * | 2/2008 | Jahelka et al. | 361/103 |
| 2008/0088991 | A1 * | 4/2008 | Elms | 361/42 |

FOREIGN PATENT DOCUMENTS

| | | | |
|---|---|---|---|
| JP | H02-82181 | U | 12/1988 |
| JP | H05-000559 | A | 1/1993 |
| JP | H06-202512 | A | 7/1994 |
| JP | H06-209572 | A | 7/1994 |
| JP | 2003220743 | A | 8/2003 |
| JP | 2005038921 | A | 2/2005 |

* cited by examiner

*Primary Examiner* — Rexford N Barnie
*Assistant Examiner* — Justen Fauth
(74) *Attorney, Agent, or Firm* — Baker Botts L.L.P.

(57) ABSTRACT

An electric power supply cut-off circuit comprises an IC which outputs a normal operation signal when the IC is operated normally, a switch which makes connection or disconnection between the IC and a power source, and a switching control circuit which continuously outputs a connection instruction signal during a period in which the normal operation signal is inputted from the IC, wherein the switch connects the IC and the power source when the connection instruction signal is inputted, and the switch cuts off the connection between the IC and the power source when the connection instruction signal is not inputted. Accordingly, it is possible to reliably avoid any excessive increase in the temperature of the IC and the ignition of the IC.

9 Claims, 10 Drawing Sheets

ELECTRIC POWER SUPPLY CUT-OFF CIRCUIT AND LIQUID DROPLET DISCHARGE APPARATUS

CROSS REFERENCE TO RELATED APPLICATION

The present application claims priority from Japanese Patent Application No. 2007-167106, filed on Jun. 26, 2007, the disclosure of which is incorporated herein by reference in its entirety.

BACKGROUND OF THE INVENTION

1. Field of the Invention

The present invention relates to an electric power supply cut-off circuit for cutting off the electric power supply from the outside when any abnormal situation arises in IC, and a liquid droplet discharge apparatus which includes such an electric power supply cut-off circuit.

2. Description of the Related Art

A variety of electronic elements are arranged at a high density in IC such as driver IC for driving an electronic apparatus such as a liquid droplet discharge apparatus. Therefore, any unintended transistor (parasitic transistor) is formed between a plurality of elements in the driver IC in some cases. When such a parasitic transistor is formed, any excess current flows through the driving device (latch up) due to the amplifying function of the parasitic transistor. It is feared that the driver IC may excessively generate the heat, and the driver IC may ignite in the worst case.

In order to avoid the excessive heat generation and the ignition of the driver IC as described above, a certain apparatus includes, in the driver IC, a circuit (thermal shutdown circuit) which is provided to stop the driver IC when the temperature of the driver IC is higher than a predetermined temperature. For example, in the case of a power source IC described in Japanese Patent Application Laid-open No. 2005-38921, an Nch-MOS transistor is connected to a thermal shutdown circuit composed of an NPN bipolar transistor. The leak current of the Nch-MOS transistor is increased as the temperature of the power source IC is raised. When the leak current of the Nch-MOS transistor is not less than 1 μA, then the thermal shutdown circuit is operated, and the operation of the power source IC is stopped.

However, in Japanese Patent Application Laid-open No. 2005-38921, the NPN bipolar transistor, which is incorporated in IC, is used as the thermal shutdown circuit. Therefore, if any parasitic transistor as described above is formed between the NPN bipolar transistor and any other element in IC, it is feared that the NPN bipolar transistor may not be operated normally, and it is impossible to stop the operation of IC.

SUMMARY OF THE INVENTION

An object of the present invention is to provide an electric power supply cut-off circuit which is capable of cutting off the electric power supply to IC before causing, for example, any excess current supply and/or ignition due to occurrence of any abnormal situation of IC, and a liquid droplet discharge apparatus which is provided with such an electric power supply cut-off circuit.

According to a first aspect of the present invention, there is provided an electric power supply cut-off circuit which cuts off an electric power supplied from a power source, the electric power supply cut-off circuit including:

an IC having an IC operation signal output circuit which outputs an IC operation signal indicating that the IC is in operation, which outputs a normal operation signal when the IC is operated normally, and which does not output the IC operation signal or outputs an abnormal operation signal when any abnormal situation arises in the IC, the normal operation signal being composed of the IC operation signal and indicating that the IC is operated normally, and the abnormal operation signal having a waveform different from that of the normal operation signal;

a switch which makes a switching operation between the IC and the power source; and a switching control circuit which controls the switching operation of the switch and which continuously outputs, to the switch, a connection instruction signal to instruct a connection between the IC and the power source during a period in which the normal operation signal is inputted from the IC operation signal output circuit;

wherein the switch makes the connection between the IC and the power source when the connection instruction signal is inputted to the switch, and the switch cuts off the connection between the IC and the power source when the connection instruction signal is not inputted to the switch.

According to the first aspect of the present invention, the normal operation signal outputted from the IC is inputted into the switching control circuit, and the connection instruction signal is outputted from the switching control circuit to the switch during the period in which the IC is operated normally. Therefore, the connection between the IC and the power source is maintained. However, when the circuit is constructed so that the normal operation signal is not outputted when any abnormal situation arises in the IC due to any cause, the connection instruction signal is not outputted from the switching control circuit to the switch, and the connection between the IC and the power source is cut off, when the abnormal situation arises in the IC. Therefore, when the abnormal situation arises in the IC, it is possible to avoid such a situation that the electric power is excessively supplied continuously from the power source to the IC, the temperature of the IC is excessively raised, and/or the IC is ignited.

On the other hand, when the circuit is constructed so that the abnormal operation signal, which has the waveform different from that of the normal operation signal, is outputted when any abnormal situation arises in the IC due to any cause, the connection state between the IC and the power source can be made different from that obtained in the normal state, when the abnormal situation arises in the IC. Therefore, it is possible to confirm that the IC suffers from any abnormality. It is possible to suppress any excessive increase in the temperature of the IC, and it is possible to avoid the ignition and the destruction, for example, by previously lowering the electric power to be supplied to the IC.

In the electric power supply cut-off circuit of the present invention, when the IC operation signal is inputted, the switching control circuit may output the connection instruction signal to the switch only for a predetermined period of time; and when the IC is operated normally, the IC operation signal output circuit may output, to the switching control circuit, the IC operation signal as the normal operation signal at a time interval which is not more than the predetermined period of time.

In this arrangement, during the period in which the IC is operated normally, the next normal operation signal is inputted into the switching control circuit before the switching control circuit completes the output of the connection instruction signal for the predetermined period of time in accordance with the output of the normal operation signal. Therefore, the connection instruction signal is always outputted continuously from the switching control circuit, and the switch maintains the connection between the IC and the power source. The voltage is continuously applied to the IC from the power source.

On the other hand, when the normal operation signal is not outputted from the IC if any abnormal situation arises in the IC due to any cause, the connection instruction signal is not outputted from the switching control circuit when the abnormal situation arises in the IC due to any cause. The connection between the IC and the power source is cut off by the switch. Therefore, when any abnormality arises in the IC, the power source is not supplied from the power source to the IC. It is possible to avoid any excessive increase in the temperature of the IC, and it is possible to avoid the ignition of the IC.

When the abnormal operation signal, which has the waveform different from that of the normal operation signal, is outputted when any abnormal situation arises in the IC due to any cause, the connection instruction signal is outputted from the switching control circuit at the timing different from that in the normal state when the abnormality arises in the IC due to any cause. It is possible to distinguish the connection and the disconnection between the IC and the power source as compared with the normal state. Therefore, it is possible to confirm that the abnormal situation arises in the IC. It is possible to suppress any excessive increase in the temperature of the IC, and it is possible to avoid the ignition and the destruction, for example, by previously lowering the electric power to be supplied to the IC.

In the electric power supply cut-off circuit of the present invention, when the abnormal situation arises in the IC, the IC operation signal output circuit may output, to the switching control circuit, the IC operation signal as the abnormal operation signal at a time interval which is longer than the predetermined period of time. In this arrangement, it is possible to easily detect that the abnormal situation arises in the IC. Further, the IC operation signal output circuit outputs, to the switching control circuit, the IC operation signal at the time interval which is longer than the predetermined period of time. Therefore, the connection instruction signal is intermittently outputted from the switching control circuit. Accordingly, the electric power is not successively supplied from the power source to the IC. It is possible to avoid any excessive increase in the temperature of the IC, and it is possible to avoid the ignition of the IC.

In the electric power supply cut-off circuit of the present invention, the IC may be a driver IC which drives a driving objective. In this arrangement, a relatively high voltage is applied to the driver IC, when the IC is the driver IC for driving the driving objective. Therefore, the temperature of the driver IC tends to be raised. However, in the present invention, the connection between the IC and the power source is cut off, and the electric power is not supplied from the power source to the driver IC, when any abnormal situation arises in the driver IC. Therefore, it is possible to avoid any excessive increase in the temperature of the driver IC, and it is possible to avoid the ignition of the driver IC.

In the electric power supply cut-off circuit of the present invention, the driver IC may have a driving signal output circuit which outputs, to the driving objective, a driving signal for driving the driving objective; and the normal operation signal may be outputted in synchronization with the driving signal. In this arrangement, for example, a strobe signal, which is outputted in synchronization with the driving signal, can be utilized as the normal operation signal. Therefore, it is unnecessary for the driver IC to newly provide any mechanism for generating the normal operation signal. It is possible to miniaturize the driver IC.

In the electric power supply cut-off circuit of the present invention, the driving objective may have a plurality of driving elements, and the driver IC may include: a driving signal output circuit which outputs, to the plurality of driving elements, driving signals for driving the plurality of driving elements; a serial-parallel converting circuit into which a plurality of pieces of driving signal instruction data indicating types of the driving signals to be outputted to the plurality of driving elements are inputted as serial signals and which outputs the plurality of pieces of the inputted driving signal instruction data as parallel signals corresponding to the plurality of driving elements; a latch circuit which retains the driving signal instruction data as the parallel signals outputted from the serial-parallel converting circuit and which outputs the retained driving signal instruction data to the driving signal output circuit; and a driving instruction signal output circuit which outputs, to the latch circuit, a driving instruction signal instructing the driving signal output circuit to output the plurality of pieces of the driving signal instruction data retained by the latch circuit; wherein the driving signal output circuit may output, corresponding to the driving elements, the driving signal indicated by the inputted driving signal instruction data when the driving signal instruction data is inputted; and the driving instruction signal output circuit may output the driving instruction signal when all of the plurality of pieces of the driving signal instruction data, corresponding to the driving elements, respectively, are retained by the latch circuit.

In this arrangement, the driver IC converts the driving signal instruction data inputted as the serial signal, into the parallel signal which is outputted. The pieces of the driving signal instruction data are retained by the latch circuit. When the pieces of the driving signal instruction data, which correspond to all of the driving elements, are retained by the latch circuit, the driving instruction signal is outputted. Accordingly, the pieces of the driving signal instruction data can be outputted to the driving signal output circuit in this arrangement.

In the electric power supply cut-off circuit of the present invention, the driving instruction signal output circuit may output the driving instruction signal to the latch circuit, and the driving instruction signal output circuit may serve also as the IC operation signal output circuit, and may output the driving instruction signal as the IC operation signal to the switching control circuit.

In this arrangement, the driving instruction signal is used as the IC operation signal. Accordingly, it is unnecessary for the driver IC to provide any circuit to output the IC operation signal distinctly from the driving instruction signal output circuit. It is possible to miniaturize the driver IC.

In the electric power supply cut-off circuit of the present invention, the IC may further include a temperature-detecting section which detects a temperature of the IC; the IC operation signal output circuit may output a pulse signal as the IC operation signal to the switching control circuit at a time interval which corresponds to the temperature detected by the temperature-detecting section; the IC operation signal output circuit may output, when the temperature detected by the temperature-detecting section is not more than a predetermined temperature, the pulse signal as the normal operation signal to the switching control circuit at a time interval which is not more than the predetermined period of time; and the IC operation signal output circuit may output, when the temperature detected by the temperature-detecting section is higher than the predetermined temperature, the pulse signal as the abnormal operation signal to the switching control circuit at a time interval which is longer than the predetermined period of time.

In this arrangement, when the temperature of the IC is not more than the predetermined temperature, the next pulse signal is inputted into the switching control circuit before the switching control circuit completes the output of the connection instruction signal. Therefore, the switch continuously keeps the connection between the IC and the power source. On the other hand, when the temperature of the IC is higher than the predetermined temperature, the abnormal operation signal is longer than the pulse signal time interval of the normal operation signal. Therefore, the output of the connection instruction signal is completed before the next pulse signal is inputted after the pulse signal is inputted into the switching control circuit. Therefore, the connection between the IC and the power source is cut off by the switch during the period until the next pulse signal is inputted after the output of the connection instruction signal is completed. In this situation, a state in which the IC and the power source are connected to one another and another state in which the connection between the IC and the power source is cut off are allowed to arise repeatedly. It is possible to confirm that the IC suffers from any abnormality. Further, it is possible to previously suppress any excessive increase in the temperature of the IC, and it is possible to avoid the ignition and the destruction of the IC, for example, by lowering the electric power to be supplied to the IC.

According to a second aspect of the present invention, there is provided a liquid droplet discharge apparatus which discharges liquid droplets, the liquid droplet discharge apparatus including:

a liquid droplet discharge head;

a driver IC which drives the liquid droplet discharge head, the driver IC including an IC operation signal output circuit which outputs an IC operation signal indicating that the IC is in operation, which outputs a normal operation signal when the driver IC is operated normally, and which does not output the IC operation signal or outputs an abnormal operation signal when any abnormal situation arises in the driver IC, the normal operation signal being composed of the IC operation signal and indicating that the driver IC is operated normally, and the abnormal operation signal having a waveform different from that of the normal operation signal;

a power source which supplies an electric power to the driver IC;

a switch which makes a switching operation between the driver IC and the power source; and a switching control circuit which receives the IC operation signal and controls the switching operation of the switch and which continuously outputs, to the switch, a connection instruction signal to instruct a connection between the driver IC and the power source during a period in which the normal operation signal is inputted, wherein the switch makes the connection between the IC and the power source when the connection instruction signal is inputted to the switch, and the switch cuts off the connection between the IC and the power source when the connection instruction signal is not inputted to the switch.

According to the second aspect of the present invention, when the driver IC is normally operated in the liquid droplet discharge apparatus having the liquid droplet discharge head, then the connection between the driver IC and the power source is always retained, and it is possible to keep the liquid droplet discharge apparatus active. However, when the driver IC suffers from any abnormality, then the driver IC is completely cut off from the power source, or the driver IC is intermittently cut off from the power source. It is impossible to discharge the liquid droplets from the liquid droplet discharge head. Therefore, it is possible to provide the liquid droplet discharge apparatus which makes it possible to avoid the destruction, the ignition, and the excessive increase in the temperature caused by the abnormal situation of the driver IC.

According to the present invention, when any abnormal situation arises in the IC, it is possible to cut off the electric power supply to the IC. Therefore, it is possible to avoid the destruction, the ignition, and the excess current with respect to the IC. Further, when the temperature of the IC is not less than the predetermined temperature, it is possible to confirm that any abnormal situation arises in the IC. Therefore, it is possible to previously avoid any abnormality including, for example, the destruction and the ignition of the IC, for example, by adjusting the electric power supply to the IC.

BRIEF DESCRIPTION OF THE DRAWINGS

FIGS. 6A and 6B show the relationship between the strobe signal outputted from a shift register shown in FIG. 5 and the ON signal outputted from the one-shot timer according to the first embodiment, wherein FIG. 5A shows a case in which no abnormal situation arises in the driver IC, and FIG. 6B shows a case in which the abnormal situation arises in the driver IC.

FIGS. 8A, 8B, and 8C show the relationship between the pulse signal outputted from an IC operation signal output circuit shown in FIG. 7 and the ON signal outputted from the one-shot timer according to the second embodiment, wherein FIG. 8A shows a case in which no abnormal situation arises in the driver IC, FIG. 8B shows a case in which the abnormal situation arises in the driver IC, and FIG. 8C shows another case in which the abnormal situation arises in the driver IC.

DESCRIPTION OF THE PREFERRED EMBODIMENTS

Preferred embodiments of the present invention will be explained below. An explanation will be made as exemplified by a liquid droplet discharge apparatus as an example of the electronic equipment or apparatus as the embodiment of the present invention.

First Embodiment

Figure 1:
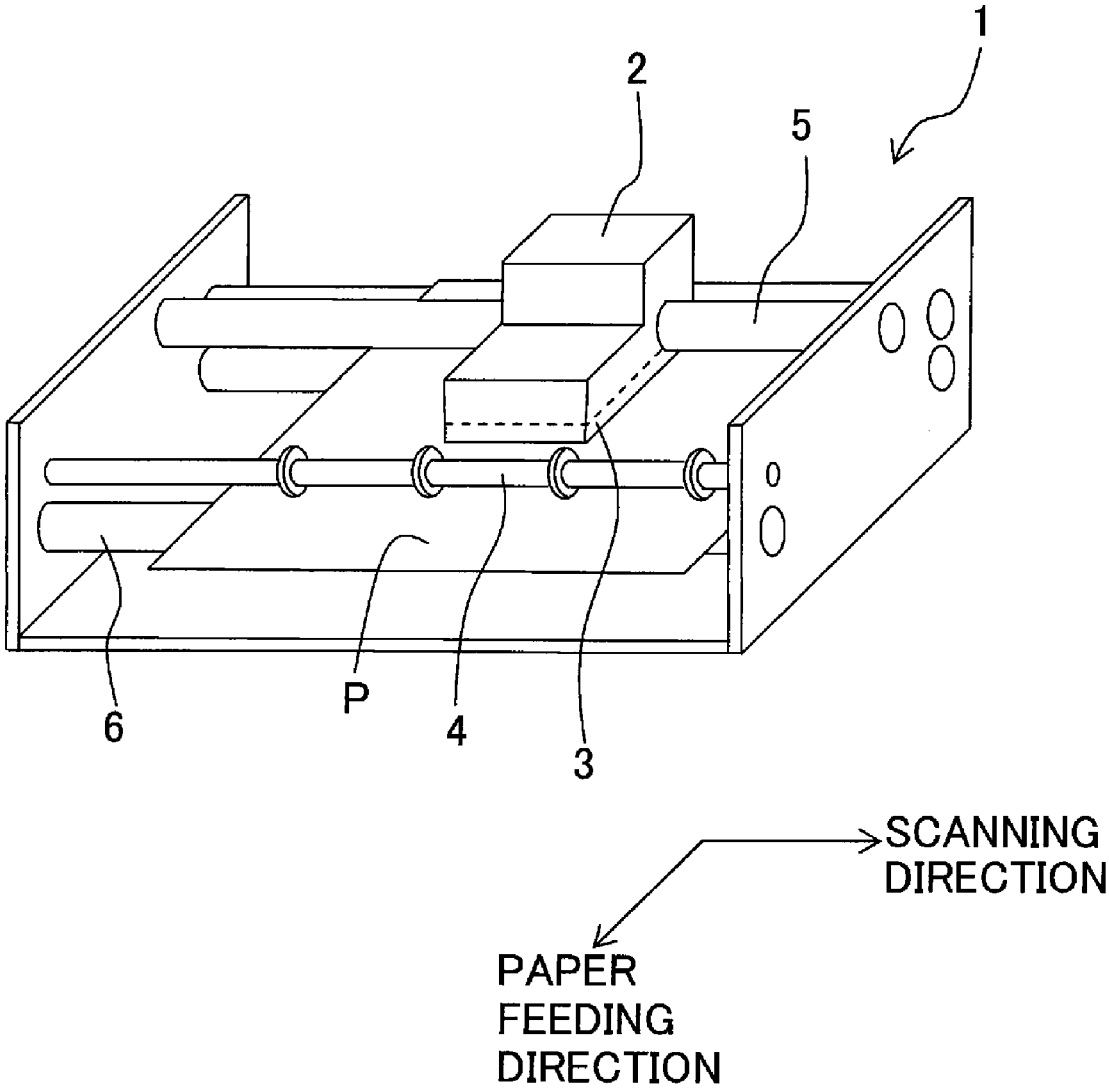
FIG. 1 shows a schematic arrangement of a printer according to an embodiment of the present invention.

FIG. 1 shows a schematic arrangement of a liquid droplet discharge apparatus 1 according to this embodiment. The liquid droplet discharge apparatus 1 is an ink-jet printer apparatus 1 for discharging inks onto a medium, which may be applied to a single ink-jet printer apparatus or which may be applied to a printer unit (recording section, printer section) of a multifunction machine provided with a plurality of units each of which functions as, for example, the facsimile and the copy. As shown in FIG. 1, the ink-jet printer apparatus 1 includes, for example, a carriage 2, an ink-jet head 3 (liquid droplet discharge head), and a printing paper transport roller 4 in the apparatus body (main body). In the following description, the direction, in which the liquid is discharged from nozzles 16, is designated as the downward direction, and the direction, which is opposite thereto, is designated as the upward direction. When the direction in the drawing is determined, if necessary, any appropriate explanation will be added.

The carriage 2 is a substantially box-shaped case made of resin, and an opening is formed in the upper surface of the carriage 2. The carriage 2 is placed movably on a guide shaft 5 which extends in the left-right direction (scanning direction) as viewed in FIG. 1. The carriage 2 makes the reciprocating movement in the left-right direction (scanning direction) by an unillustrated driving unit. Exchangeable ink cartridges (not shown), which supply a plurality of types of inks (for example, four color inks of black, yellow, magenta, and cyan), are arranged in the main body of the ink-jet printer apparatus 1. The respective ink cartridges are connected via ink tubes (not shown) to the ink-jet head 3 placed in the carriage 2. The printing paper transport roller 4 and a platen 6 are arranged opposingly under or below the carriage 2. The recording paper P is transported in the frontward direction (paper feeding direction) as viewed in FIG. 1 between the printing paper transport roller 4 and the platen 6. The ink-jet head 3 is adhered and fixed to the lower surface of the carriage 2. A plurality of nozzles 16 (see FIG. 2) are formed to be exposed on the lower surface of the carriage 2. The ink-jet head 3 discharges the inks from the plurality of nozzles 16 while making the reciprocating movement in the scanning direction together with the carriage 2. Accordingly, the printing is performed on the recording paper P. The recording paper P, on which the printing is completed, is discharged by the printing paper transport roller 4. A head-side substrate 52 (see FIG. 4), which is electrically connected to a certain element in the main body of the ink-jet printer, is installed on the upper surface of the carriage 2.

Figure 2:
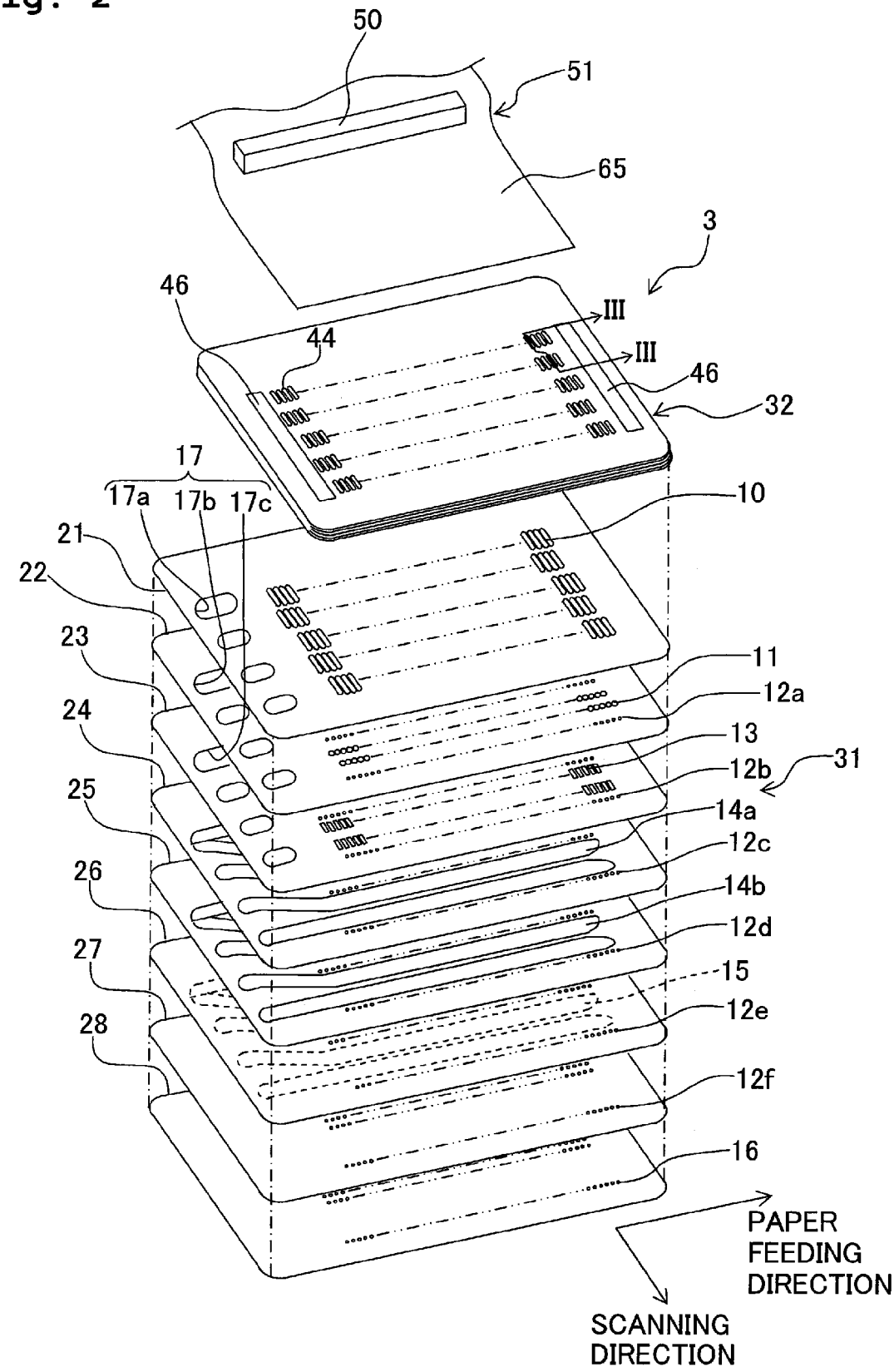
FIG. 2 shows an exploded perspective view illustrating an ink-jet head shown in FIG. 1.
Figure 3:
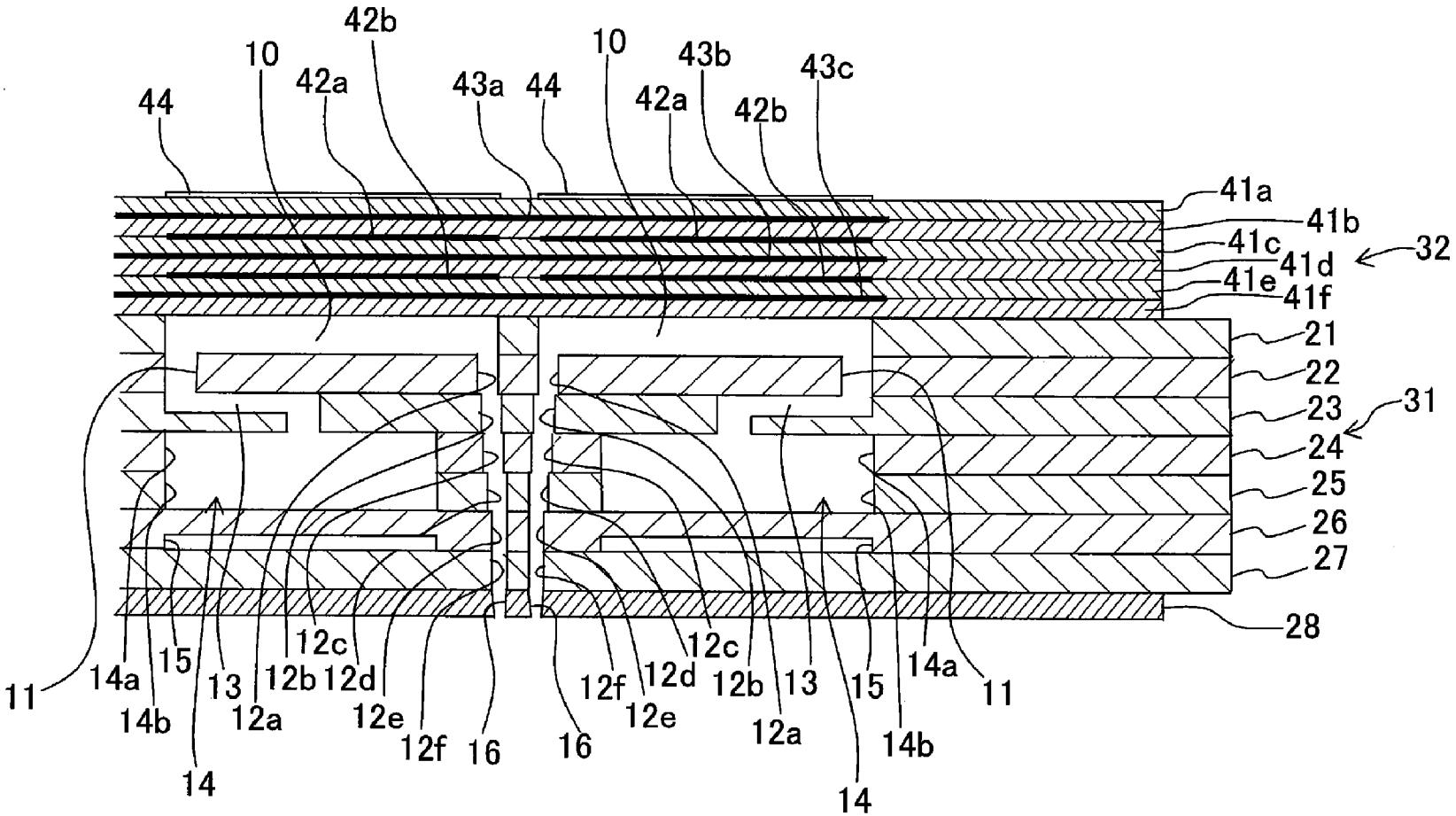
FIG. 3 shows a sectional view taken along a line III-III in a state in which the ink-jet head shown in FIG. 2 is assembled.

Next, the ink-jet head 3 will be explained. FIG. 2 shows an exploded perspective view illustrating the ink-jet head 3 shown in FIG. 1. FIG. 3 shows a sectional view, taken along a III-III line, of the ink-jet head 3 shown in FIG. 2.

As shown in FIGS. 2 and 3, the ink-jet head 3 includes a flow passage unit 31 and a piezoelectric actuator 32 (driving objective) which are joined to one another, wherein the flow passage unit 31 is formed with a plurality of ink flow passages including, for example, the plurality of nozzles 16 and pressure chambers 10, and the piezoelectric actuator 32 is arranged on the upper surface of the flow passage unit 31 to apply the pressure in order to discharge the inks with which the pressure chambers 10 are filled. The ink-jet head 3 is electrically joined to a flexible wiring member 51 which has a driver IC 50 mounted on the upper surface.

The flow passage unit 31 includes eight plates of a cavity plate 21, a base plate 22, an aperture plate 23, two manifold plates 24, 25, a damper plate 26, a cover plate 27, and a nozzle plate 28. These plates are stacked and joined to one another by means of an adhesive. The seven plates 21 to 27 except for the nozzle plate 28, are formed of metal materials such as stainless steel plates and nickel alloy steel plates. The nozzle plate 28 is formed of a synthetic resin material such as polyimide. The nozzle plate 28 may be also formed of a metal material in the same manner as the other plates 21 to 27.

The ink flow passages, which are provided in the flow passage unit 31, are formed by ink supply flow passages 17 (penetrating holes 17*a* to 17*c*), manifold flow passages 14 (penetrating holes 14*a*, 14*b*), apertures 13, through-holes 11, pressure chambers 10, through-holes 12*a* to 12*f*, and nozzles 16. The inks, which are supplied from the ink cartridges, are allowed to flow through the ink supply flow passages 17 (penetrating holes 17*a* to 17*c*) provided in the flow passage unit 31, and the inks are stored in the manifold flow passages 14 (penetrating holes 14*a*, 14*b*). The manifold flow passages 14 are communicated with the plurality of pressure chambers 10 via the apertures 13 and the through-holes 11. The respective pressure chambers 10 are communicated with the plurality of nozzles 16 via the through-holes 12*a* to 12*f*. The pressure is selectively applied by the piezoelectric actuator 32 to the ink with which the pressure chamber 10 is filled. The pressure wave is transmitted, and thus the ink, with which each of the ink flow passages in the flow passage unit 31 is filled, is discharged from the nozzle 16. Details will be explained below.

Five nozzle arrays are formed in the scanning direction on the nozzle plate 28 disposed at the lowermost layer of the flow passage unit 31. Each of the nozzle arrays has the plurality of nozzles 16 which are arranged in the paper feeding direction. The ink of the same color is discharged from the nozzles 16 included in each of the nozzle arrays respectively. Although the inks are those of the four colors, the number of the nozzle arrays of the nozzles 16 is five, for the following reason. That is, the two nozzle arrays are provided in order to discharge the black ink to be used highly frequently.

The plurality of pressure chambers 10 are formed in the cavity plate 21 disposed at the uppermost layer corresponding to the plurality of nozzles 16. In other words, the five pressure chamber arrays are formed in the scanning direction. Each of the pressure chamber arrays has the plurality of pressure chambers 10 which are aligned in the paper feeding direction. In this arrangement, the pressure chambers 10 are formed such that the plurality of through-holes, which are formed through the cavity plate 21, are covered with the actuator 32 and the base plate 22 at the upper and lower positions. Each of the pressure chambers 10 has a shape which is elongated in the scanning direction. One end thereof is communicated with the through-hole 11, and the other end is communicated with the nozzle 16. The plurality of penetrating holes 17*a*, which are aligned in the scanning direction, are formed at one end (left end as shown in FIG. 2) of the cavity plate 21 in the paper feeding direction to construct the four ink supply flow passages 17 for supplying the plurality of inks (four colors) from the ink cartridges to the manifold flow passages 14.

The through-holes 11, 12*a* are formed at the positions of the base plate 22 overlapped with the both ends of the pressure chambers 10 in the longitudinal direction as viewed in a plan view respectively. The penetrating holes 17*b*, which constitute the ink supply flow passages 17, are formed at the positions of the base plate 22 overlapped with the penetrating holes 17*a* as viewed in a plan view.

The apertures 13, which extend from the positions overlapped with the through-holes 11 as viewed in a plan view to the substantially central portions of the corresponding pressure chambers 10 in the longitudinal direction, are formed in the aperture plate 23. The aperture 13 functions as a throttle. The through-holes 12*b* and the penetrating holes 17*c* are formed at the positions of the aperture plate 23 overlapped with the through-holes 12*a* and the penetrating holes 17*b* as viewed in a plan view respectively. The ink supply flow passages 17 are formed by the penetrating holes 17*a* to 17*c* which are overlapped with each other.

The five penetrating holes 14*a*, 14*b*, which extend in the paper feeding direction, are formed in the manifold plates 24, 24 respectively corresponding to the five arrays of the pressure chambers 10 formed in the cavity plate 10. The penetrating holes 14*a*, 14*b* are formed so that they are opposed to one another. The penetrating holes 14*a*, 14*b* are overlapped with the ends of the pressure chambers 10 in the longitudinal direction as viewed in a plan view. One end side portions of the penetrating holes 14*a*, 14*b* are provided to extend to arrive at the positions overlapped with the ink supply flow passages 17, which are communicated with the ink supply flow passages 17. The aperture plate 23 and the damper plate 26 are stacked on the upper and lower surfaces of the manifold plates 24, 25 respectively. Accordingly, the upper openings of the penetrating holes 14*a* and the lower openings of the penetrating holes 14*b* are covered with the aperture plate 23 and the damper plate 26 respectively to form the manifold flow passages 14. The respective inks, which are supplied from the ink supply flow passages 17, are stored in the manifold flow passages 14. The through-holes 12*c*, 12*d* are formed at the positions of the manifold plates 24, 25 overlapped with the through-holes 12*b* as viewed in a plan view respectively. The five manifold flow passages 14 are provided with respect to the four ink supply flow passages 17 for supplying the four color inks, for the following reason. That is, the two manifold flow passages 14 correspond to the ink supply flow passage 17 for supplying the black ink to be used highly frequently.

Five arrays of recesses 15 are formed, by the half etching or the like, at the positions of the lower surface of the damper plate 26 overlapped with the manifold flow passages 14 respectively as viewed in a plan view. In other words, the thicknesses of the damper plate 26, at which the recesses 15 are formed, are thinner than those of the other portions. The pressure wave, which is generated in the pressure chamber 10 when the ink is discharged from the nozzle 16 by driving the piezoelectric actuator 32 and which is transmitted to the manifold flow passage 14 as described later on, is attenuated by the vibration of the portion having the thin thickness. Accordingly, the so-called crosstalk, in which discharge characteristic of the ink to be discharge from the nozzle 16 is fluctuated by being influenced by the pressure wave, is avoided. Further, the through-holes 12*e* are formed at the positions of the damper plate 26 overlapped with the through-holes 12*d* as viewed in a plan view.

The through-holes 12*f* are formed at the positions of the cover plate 27 overlapped with the through-holes 12*e* as viewed in a plan view, the positions being overlapped and communicated with the nozzles 16 of the nozzle plate 28 as viewed in a plan view.

The flow passage unit 31 is formed by stacking and joining the respective plates 21 to 28.

Next, the piezoelectric actuator 32 will be explained. The piezoelectric actuator 32 has piezoelectric layers 41*a* to 41*f*, individual electrodes 42*a*, 42*b* (collectively referred to as "individual electrodes 42"), surface individual electrodes 44, and common electrodes 43*a* to 43*c* (collectively referred to as "common electrodes 43"), and surface common electrodes 46.

The piezoelectric layers 41*a* to 41*f* have plate-shaped forms having sizes to such an extent that all of the pressure chambers 10 are covered therewith, and the piezoelectric layers 41*a* to 41*f* are stacked with each other in the direction (stacking direction) perpendicular to the surface direction. In other words, the piezoelectric layers 41*a* to 41*f* are arranged continuously to cover the plurality of pressure chambers 10 on the upper surface of the flow passage unit 31. Each of the piezoelectric layers 41*a* to 41*f* is composed of a piezoelectric material which is, for example, a mixed crystal of lead titanate and lead zirconate (metal oxide of the three-component system) and which has a main component of lead titanate zirconate having the ferroelectricity. The piezoelectric layers 41*a* to 41*f* are previously polarized in the thickness direction thereof.

The individual electrodes 42*a*, 42*b* are provided between the piezoelectric layers 41*b* and 41*c* and between the piezoelectric layers 41*d* and 41*e* respectively. The individual electrodes 42*a*, 42*b* are arranged corresponding to the plurality of pressure chambers 10. Specifically, five electrode arrays are formed in the scanning direction. Each of the electrode arrays has the plurality of individual electrodes 42*a*, 42*b* arranged in the paper feeding direction. Each of the individual electrodes 42*a*, 42*b* has a substantially slender shape (elongated shape) as viewed in a plan view, the shape being one size smaller than the pressure chamber 10. The individual electrodes 42*a*, 42*b* are arranged at the positions overlapped with the substantially central portions of the pressure chambers 10 as viewed in a plan view. The individual surface electrodes 44 are arranged at the positions of the piezoelectric layer 41 disposed at the uppermost layer overlapped with the individual electrodes 42 as viewed in a plan view. The individual surface electrodes 44 and the individual electrodes 42*a*, 42*b* mutually make the conduction, for example, via a conductive material filled in unillustrated through-holes formed in the piezoelectric layers 41*a* to 41*f*.

The common electrodes 43*a* to 43*c* are formed between the piezoelectric layers 41*a* and 41*b*, between the piezoelectric layers 41*c* and 41*d*, and between the piezoelectric layers 41*e* and 41*f*, respectively. The common electrodes 43*a* to 43*c* are formed to cover the substantially entire regions of the surfaces of the piezoelectric layers 41*a* to 41*f*. The common surface electrodes 46 are formed in the vicinity of the both ends in the paper feeding direction on the upper surface of the piezoelectric layer 41*a* disposed at the uppermost layer. The respective common electrodes 43*a* to 43*c* and the surface common electrodes 46 mutually make the conduction, for example, via a conductive material filed in unillustrated through-holes, in the same manner as the individual electrodes 42.

Each of the individual surface electrode 44 and the common surface electrode 46 is an Ag—Pd-based electrode having an upper surface on which an unillustrated Ag connecting terminal is formed. The Ag connecting terminals and the unillustrated connecting electrodes of the flexible wiring member 51 arranged on the surface of the piezoelectric actuator 32 are joined to one another to make the conduction by the aid of a conductive brazing material such as solder.

The flexible wiring member 51 is formed with a plurality of wirings. One end thereof is joined to the piezoelectric actuator 32, and the other end is connected to the connector 103 of the head substrate 52 for making the connection to the control circuit disposed in the main body. The driver IC 50 is mounted on the surface of the flexible wiring member 51. The driving electric potential is selectively applied to the individual electrodes 42*a*, 42*b* of the actuator 32 in accordance with the driving signal supplied from the control circuit disposed in the main body via the driver IC 50. The common surface electrode 46 is always retained at the ground electric potential by the driver IC 50 (see FIG. 4) mounted on the surface of the flexible wiring member 51. Accordingly, the common electrode 43 is retained at the ground electric potential as well. In the case of this embodiment, the flexible wiring member 51 has a chip on film (COF), which is joined to the actuator 32 and on which the driver IC 50 is mounted, and a flexible flat cable (FFC) connected to the connector 103. As described above, two sheets of the wiring members are used as the flexible wiring member 51. However, the present invention is not limited thereto. For example, the flexible wiring member 51 may have only one sheet of COF. Alternatively, the flexible wiring member 51 may have three or more sheets of the wiring members. It is also possible to use a flexible print cable (FPC) in place of the flexible flat cable.

When the driving electric potential is applied to the individual electrode 42 via the predetermined surface individual electrode 44 from the driver IC 50 in the piezoelectric actuator 32, the difference in the electric potential arises between the individual electrode 42 and the common electrode 43. Therefore, the electric field is generated in the thickness direction at the portions of the piezoelectric layers 41*a* to 41*e* interposed by the individual electrode 42 and the common electrode 43. The direction of the electric field is parallel to the direction of polarization of the piezoelectric layers 41*a* to 41*e*. Therefore, the piezoelectric layers 41*a* to 41*e* are elongated in the thickness direction in accordance with the piezoelectric vertical effect. Therefore, the piezoelectric layer 41*f* is deformed so that the piezoelectric layer 41*f* is convex toward the pressure chamber 10 by being pressed by the piezoelectric layers 41*a* to 41*e* elongated in the thickness direction. Accordingly, the volume of the pressure chamber 10 is decreased. The pressure of the ink contained in the pressure chamber 10 is increased in accordance with the decrease in the volume of the pressure chamber 10. The pressure wave is generated, and the ink is discharged from the nozzle 16 communicated with the pressure chamber 10. Each of the portions of the piezoelectric layers 41*a* to 41*f* overlapped with each of the pressure chambers 10, the portion of the common electrode 43 overlapped with the pressure chamber 10, and the portion of the individual electrode 42 overlapped with the pressure chamber 10 of the piezoelectric actuator 32 corresponds to one driving element according to the present invention. The piezoelectric actuator 32 is provided with the plurality of driving elements. The so-called pull type jetting operation may be adopted as described below as the method for discharging the ink by applying the pressure to the ink in accordance with the piezoelectric vertical effect. In the pull type jetting operation, at first, the piezoelectric layer is deformed beforehand so that the piezoelectric layer is convex toward the pressure chamber 10 by applying the driving voltage. Subsequently, the driving voltage is turned off, and thus the deformation of the piezoelectric layer is once returned to the original to increase the volume of the pressure chamber. The driving voltage is applied again after a predetermined period of time elapses, and thus the piezoelectric layer is deformed so that the volume of the pressure chamber is returned to be in the initial state. Accordingly, the pressure is applied to the ink.

Figure 4:
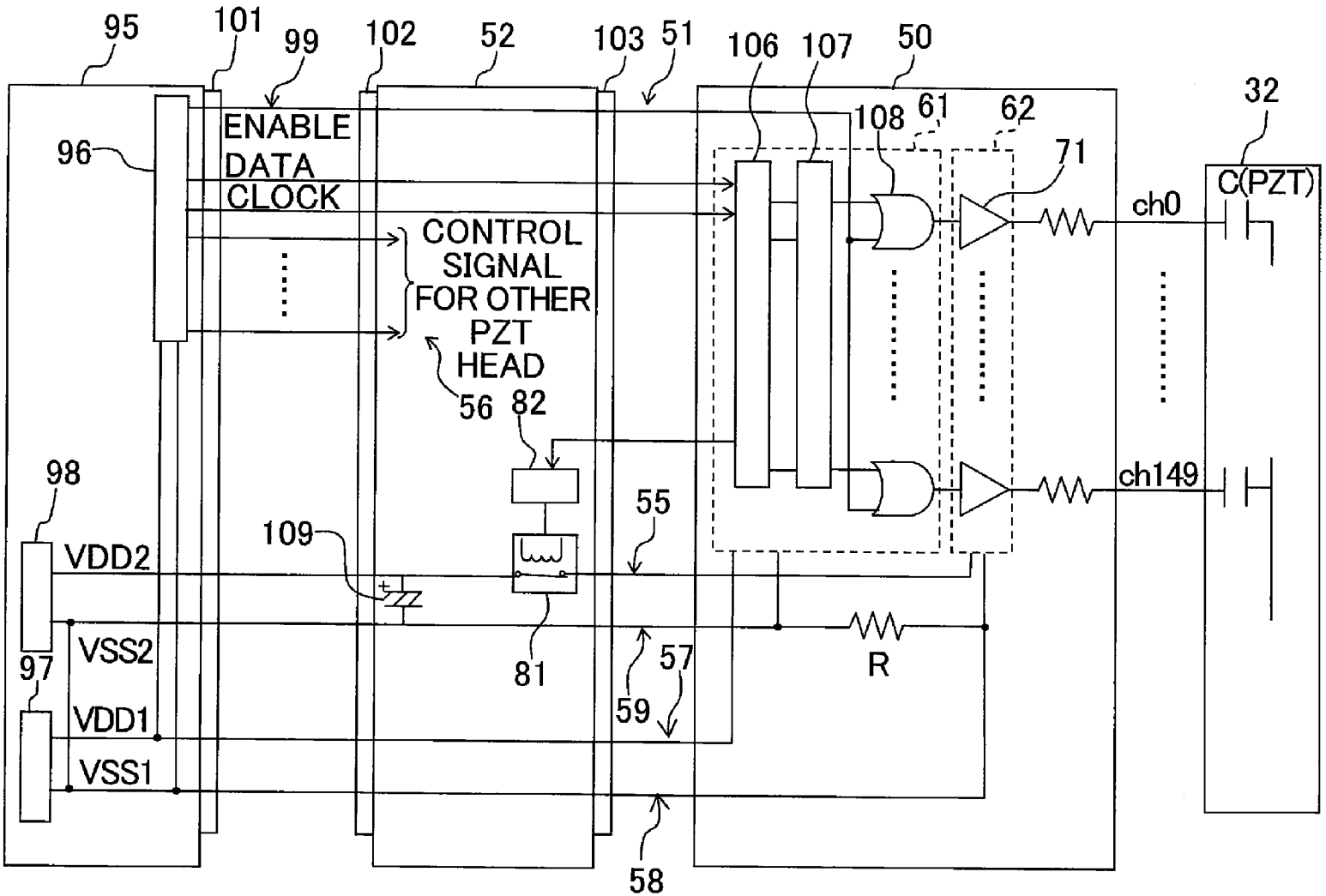
FIG. 4 conceptually shows an electric arrangement of the printer shown in FIG. 1 according to the first embodiment of the present invention.
Figure 5:
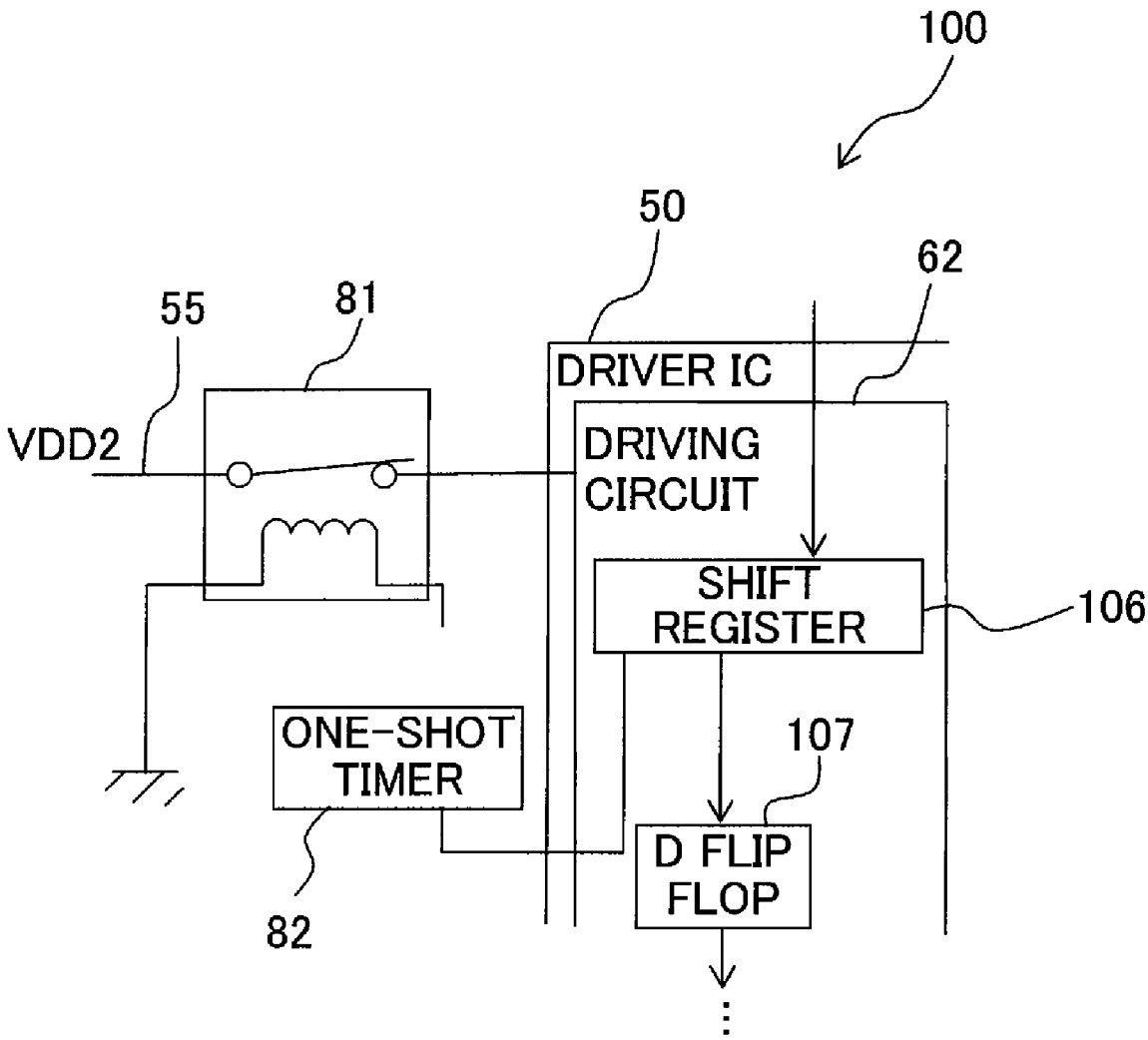
FIG. 5 shows a block diagram illustrating the relationship of connection of a driver IC, a one-shot timer, and a relay shown in FIG. 4 according to the first embodiment.

Next, an explanation will be made about an electric arrangement of the ink-jet printer apparatus 1. FIG. 4 conceptually shows the electric arrangement of the ink-jet printer apparatus 1. FIG. 5 shows a block diagram illustrating the relationship of connection of the driver IC 50, a one-shot timer 82, and a relay 81 shown in FIG. 4.

In the ink-jet printer apparatus 1, as shown in FIG. 4, the body-side substrate 95 is connected to the head-side substrate 52. Further, the head-side substrate 52 is connected to the driver IC 50. The body-side substrate 95 is not mounted on the carriage 2, but is arranged in the casing of the ink-jet printer apparatus 1. A body-side control circuit 96, a power source 97 for the control signal (control-signal power supply), and a power source 98 for the driving pulse (drive-pulse power supply) are located on the body-side substrate 95. On the other hand, the head-side substrate 52 is mounted on the upper surface of the carriage 2 together with the piezoelectric actuator 32. As shown in FIG. 2, the driver IC 50 is mounted on the surface of the flexible wiring member 51. A control circuit 61 and a driving circuit 62 are formed on the driver IC 50.

The body-side control circuit 96 outputs the control signals including, for example, enable, data, and clock signals to the control circuit 61 on the basis of the predetermined printing data. The control signals are transmitted to the driving circuit 62 via control signal lines 56. The control-signal power supply 97 supplies the electric power to the control circuit 61 (for example, a voltage of 5 volts is applied), which is connected to the control circuit 61 via a driving VDD1 wiring 57 for applying the driving voltage and a grounding VSS1 wiring 58.

The driving-pulse power supply 98 supplies the driving electric power (for example, a voltage of 16 volts) to the driving circuit 62, which is connected to the driving circuit 62 via a driving VDD2 wiring 55 for applying the driving voltage and a grounding VSS2 wiring 59.

Specifically, as shown in FIG. 4, the body-side substrate 95 and the head-side substrate 52 are connected to one another by a flexible flat cable 99. The flexible flat cable 99 includes the driving VDD1 wiring 57, the grounding VSS1 wiring 58, the control signal wiring 56, the driving VDD2 wiring 55, and the grounding VSS2 wiring 59, which are arranged in a planar form in the widthwise direction of the cable 99. The respective ends of the flexible flat cable 99 are connected to a connector 101 which is arranged on the body-side substrate 95 and a connector 102 which is arranged on the head-side substrate 52 respectively.

The head-side substrate 52 further includes a connector 103. The flexible wiring member 51, which is joined to the actuator 32 and on which the driver IC 50 is mounted, is connected to the connector 103. The head-side substrate 52 is connected to the driver IC 50 via the control signal line 56, the driving VDD1 wiring 57, the grounding VSS1 wiring 58, the driving VDD2 wiring 55, and the grounding VSS2 wiring 59. In this arrangement, the driver IC 50 is mounted on the surface of the substrate 65 of the flexible wiring member 51 provided on the surface of the substrate 65 (see FIG. 5). One end of each of the control signal line 56, the driving VDD1 wiring 57, the grounding VSS1 wiring 58, the driving VDD2 wiring 55, and the grounding VSS2 wiring 59 is connected to the connector 103 of the head substrate 52, and the other end is connected to the driver IC 50 of the flexible wiring member 51.

The grounding VSS1 wiring 58 and the grounding VSS2 wiring 59 are connected to one another, and they are retained at the ground electric potential. Accordingly, the reference electric potential (common electric potential, ground electric potential in the case of this embodiment) is defined for the control circuit 61, the driving circuit 62, and the piezoelectric actuator 32. A branched wiring of the grounding VSS2 wiring 59 and the grounding VSS1 wiring 58 are connected to one another via a resistor R. The driving circuit 62 and the control circuit 61 are retained at the same electric potential. A COM wiring 67, which is connected to the common surface electrode 46 of the actuator 32, is mutually connected to the grounding VSS2 wiring 59, which is retained at the ground electric potential. Specifically, the COM wiring 67 and the grounding VSS2 wiring 59 are connected by the solder point on the flexible wiring member 51.

An electrolytic capacitor 109, which bypass-connects the driving VDD2 wiring 55 and the grounding VSS2 wiring 59, is provided on the head-side substrate 52. The electric charges, which is to be supplied to a driving pulse-generating circuit 97, are stored in the electrolytic capacitor 109. Accordingly, it is possible to suppress the occurrence of the voltage drop of the driving-pulse power supply 98 even when any large instantaneous current flows through the driving pulse-generating circuit 97.

The relay 81 (switching mechanism), which is capable of cutting off the connection between the driving-pulse power supply 98 and the driving device 62 effected by the driving VDD2 wiring 55, is arranged on the head-side substrate 52. The connection and the disconnection between the driving-pulse power supply 98 and the driving circuit 62 are switched by the relay 81. The switching operation of the relay 81 is controlled by the one-shot timer 82 (switching control circuit) provided on the head-side substrate 52.

Specifically, the one-shot timer 82 outputs the ON signal (connection instruction signal) to the relay 81 when the strobe signal, which is outputted from the shift register 106 of the driver IC 50 as described later on, is received. When the relay 81 receives the ON signal, the relay 81 is turned ON for a predetermined period of time Tm, that is, the driving-pulse power supply 98 and the driving circuit 62 are connected to one another for the period of time Tm. The relay 81 is turned ON only during the period in which the ON signal is inputted. In this situation, the driving-pulse power supply 98 and the driving device 62 are connected to one another by means of the driving VDD2 wiring 55. Accordingly, the driving electric power is supplied to the driving device 62.

On the other hand, when the ON signal is not inputted into the relay 81, the relay 81 is turned OFF, that is, the connection between the driving-pulse power supply 98 and the driving circuit 62 is cut off. In this situation, the connection between the driving-pulse power supply 98 and the driving circuit 62 effected by the driving VDD2 wiring 55 is cut off by the relay 81. Accordingly, the driving electric power is not supplied from the driving-pulse power supply 98 to the driving circuit 62.

The control circuit 61 generates the control signal corresponding to each of the driving elements on the basis of the control signal such as the printing data supplied from the body-side control circuit 96. The control circuit 61 is provided with a shift register 106, a D flip flop 107 (latch circuit), and an OR gate 108 which are connected to one another.

The numbers of the shift registers 106, the D flip flops 107, and the OR gates 108 correspond to the number of the nozzles 16 (for example, when the head has 150 of nozzles 16, 150 of shift registers 106 or the like are prepared). The data and clock signals, which are included in the control signals transmitted from the body-side control circuit 96 via the control signal wiring 56, are synchronized, and the signal lines thereof are connected to the shift register 106. The signal line of the enable signal is connected to the OR gate 108. The signal lines of the data and clock signals are outputted to the driving circuit 62 by being branched into the driving electric potential line and the channel selection line, the driving electric potential line being used for converting the driving instruction signal into the driving electric power suitable for the piezoelectric actuator 32 in the driving circuit 62, and the channel selection line being used for determining the nozzle 16 (channel) from which the ink is to be discharged.

The driving circuit 62 generates the driving electric power to drive the piezoelectric actuator 32 on the basis of the control signal outputted from the control circuit 61. A plurality of drivers 71 (driving signal output circuits) of the same number as the number of the nozzles 16 are prepared in the driving circuit 62 (for example, 150 drivers 71 are provided for 150 nozzles 16). The input end to the driver 71 is connected to the OR gate 108. The output end is connected to the individual surface electrode 44 and the individual common electrode 46 of the piezoelectric actuator 32. The driving electric potential is applied (driving signal is outputted) from the driver 71 to the individual surface electrode 44.

An explanation will now be made about the flow of the signal until the driving signal is outputted to the piezoelectric actuator by the driving circuit 62 after the printing data is inputted into the control circuit 61.

The signal of the printing data of each of the channels (driving signal instruction data to indicate the type of the driving signal) is inputted as the serial signal from the signal line of the data signal into the shift register 106 of the control circuit 61. When the signal of the printing data of the serial signal is inputted, then the shift register 106 converts the serial signal to the parallel signal (performs the serial-parallel conversion), and the converted parallel signal is outputted to the D flip flop 107. The printing data of the parallel signal inputted from the shift register 106 is retained (latched) in the D flip flop 107.

In the first embodiment, the shift register 106 serves as both of the serial-parallel converting circuit according to the present invention and the strobe signal output circuit (driving instruction signal output circuit). In other words, the shift register 106 is capable of generating and outputting the strobe signal (driving instruction signal) as well. After the printing data corresponding to all of the channels is inputted into the shift register 106, the signal, which indicates that the input of the printing data is completed, is inputted from the signal line of the data signal into the shift register 106. When this signal is inputted, the strobe signal (driving instruction signal), which is the pulse signal to instruct that the latched printing data is outputted to the driver 71 via the OR gate 108, is outputted by the shift register 106 to the D flip flop 107. In this situation, the shift register 106 also outputs the strobe signal to the one-shot timer 82 as described later on.

When the strobe signal is inputted into the D flip flop 107, the signal of the printing data, which corresponds to all of the channels latched in synchronization with the inputted strobe signal, is outputted from the D flip flop 107 via the OR gate 108 to the driver 71. Each of the drivers 71 applies the driving electric potential (outputs the driving signal) to the corresponding surface individual electrode 44 in the channel into which the signal of the printing data to indicate the discharge of the ink is inputted. The driving electric potential as described above is not applied (driving signal is not outputted) in the channel into which the signal of the printing data to indicate no discharge of the ink is inputted. That is, the driver 71 outputs the driving signal indicated by the inputted printing data. Accordingly, the ink is discharged from only the nozzle 16 corresponding to the channel into which the signal of the printing data to indicate the discharge of the ink is inputted.

FIG. 6 shows the relationship between the strobe signal outputted from the shift register 106 and the ON signal outputted from the one-shot timer 82. In the first embodiment, the strobe signal (driving instruction signal) also serves as the IC operation signal to indicate that the driver IC of the present invention is in operation. In other words, the shift register 106 also serves as the driving instruction signal output signal as described above, and the shift register 106 also serves as the IC operation signal output circuit.

The strobe signal (driving instruction signal and IC operation signal), which has a pulse width Ts, is outputted at a pulse interval time Tw from the shift register 106 (driving instruction signal output circuit and IC operation signal output circuit) to the one-shot timer 82 and the D flip flop 107. When one strobe signal (a) is received (when the strobe signal falls), the one-shot timer 82 continuously outputs the ON signal (a) for a period of time Tm.

Figure 6A:
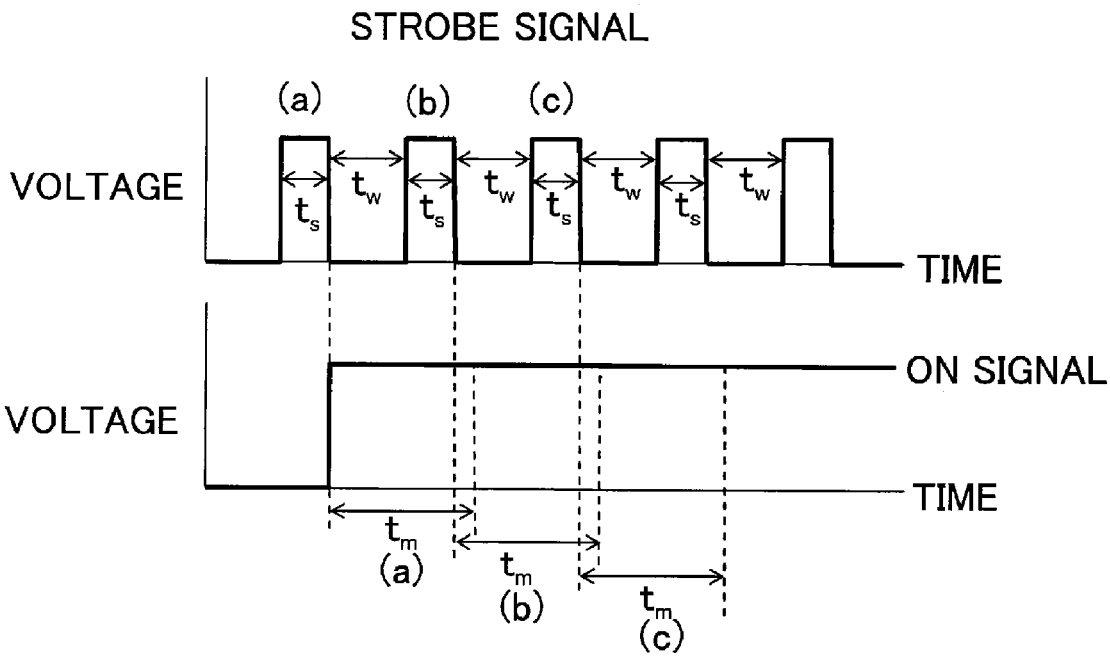

When the driver IC 50 is operated normally, the one-shot timer 82 is operated as shown in FIG. 6A. The one-shot timer 82 outputs the ON signal (a) for a predetermined period of time Tm after the strobe signal (a) is received, i.e., after the strobe signal falls. Further, the next strobe signal (b) is received to successively output the next ON signal (b) before the output of the ON signal (a) is completed (before the ON signal (a) falls). As shown in FIG. 6A, the output time Tm of the ON signal is not more than the total time of the pulse width Ts and the pulse interval Tw of the strobe signal (Tm≧Tw+Ts). In other words, when the driver IC 50 is operated normally, the strobe signal is outputted from the shift register 106 to the one-shot timer 82 at a time interval Tw+Ts which is not more than the predetermined period of time Tm. The signal, which is composed of the strobe signals, is the normal operation signal to indicate that the driver IC 50 is operated normally.

As a result, the power source for the driving pulse and the driving circuit 62 are kept being connected to one another via the driving VDD2 wiring 55, while the ON signal is continuously outputted from the one-shot timer 82 to the relay 81. In other words, when the driver IC is operated normally, and the strobe signal is outputted at the time interval which is not more than the predetermined time interval, then the ON signal is always outputted from the one-shot timer 82. Therefore, the driving-pulse power supply 98 and the driving circuit 62 (driver IC 50) are kept being connected to one another by means of the driving VDD2 wiring 55. The driving electric power is continuously supplied from the driving-pulse power supply 98 to the driving circuit 62.

Figure 6B:
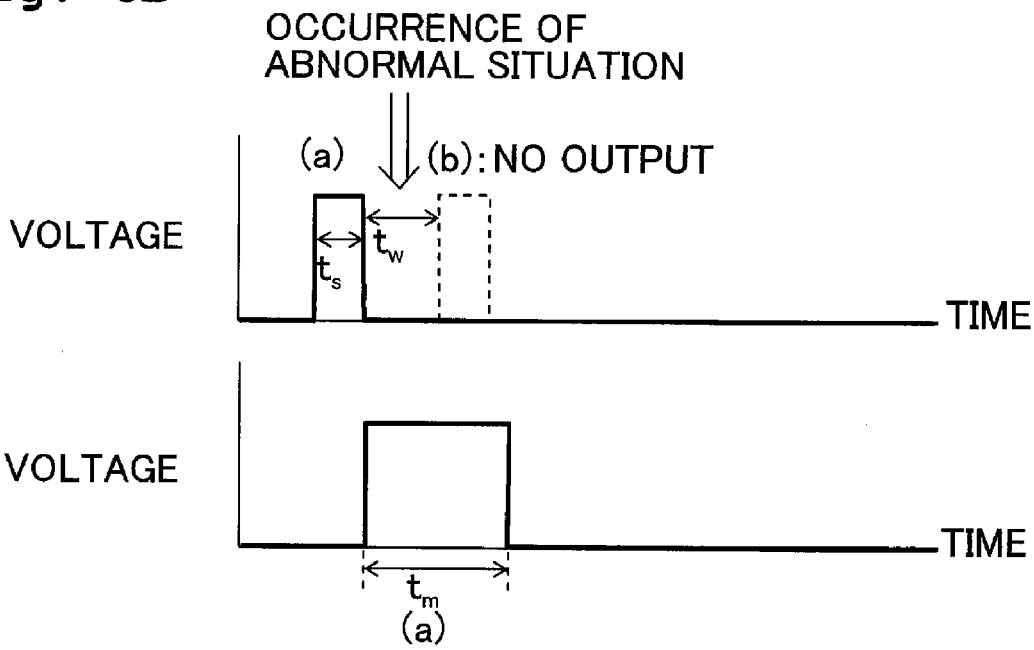

On the other hand, when the driver IC 50 is destructed due to the occurrence of any abnormal situation in the driver IC 50 caused, for example, by the heat generation and/or the excess current allowed to flow through the driver IC 50, the strobe signal (b) is not outputted due to the occurrence of the abnormal situation as shown in FIG. 6B. Therefore, the one-shot timer 82 does not output the ON signal (b) after the ON signal (a) is outputted for the time Tm after the strobe signal (a) is finally received. When the ON signal is not outputted, the connection between the driving-pulse power supply 98 and the driving circuit 62, which is effected by the driving VDD2 wiring 55, is cut off by the relay 81. Therefore, the driving electric power is not supplied thereafter from the driving-pulse power supply 98 to the driving circuit 62. Therefore, it is possible to avoid the excessive increase in the temperature of the driver IC and the ignition of the driver IC 50 which would be otherwise caused by the current allowed to continuously flow even after any abnormal situation arises in the driver IC 50 due to any cause and the driver IC 50 is destructed.

In the first embodiment, the strobe signal corresponds to the normal operation signal according to the present invention to indicate that the driver IC is operated normally. Therefore, it is unnecessary to distinctly provide, for the driver IC 50, for example, any circuit to output the normal operation signal. It is possible to miniaturize the driver IC 50. Further, the shift register 106 is also provided with the driving instruction signal output circuit. Therefore, it is also possible to miniaturize the driver IC 50 thereby.

According to the first embodiment explained above, when the driver IC 50 is operated normally, the relationship of Tm≧Tw+Ts holds between the output time Tm of the ON signal and the pulse interval Tw and the pulse time Ts of the strobe signal. In other words, the next strobe signal is inputted into the one-shot timer 82 before the one-shot timer 82 completes the output of the ON signal in accordance with the output of the strobe signal. As a result, the ON signal is always outputted continuously from the one-shot timer 82 to the relay 81. Therefore, the power source 92 for the driving pulse and the driving circuit 62 are kept being connected to one another. The voltage is continuously applied from the driving-pulse power supply 98 to the driver IC 50.

When any abnormal situation arises in the driver IC due to any cause, and the strobe signal is not outputted from the shift register 106, then the next ON signal is not outputted from the one-shot timer 82 to the relay 81 after the elapse of the time Tm after the strobe signal finally falls in the one-shot timer 82. As a result, the connection between the driving-pulse power supply 98 and the driving circuit 62 is cut off. Therefore, the electric power is not supplied from the driving-pulse power supply 98 to the driver IC 50. It is possible to avoid the excessive increase in the temperature of the driver IC 50 and the ignition of the driver IC 50.

Second Embodiment

Figure 7:
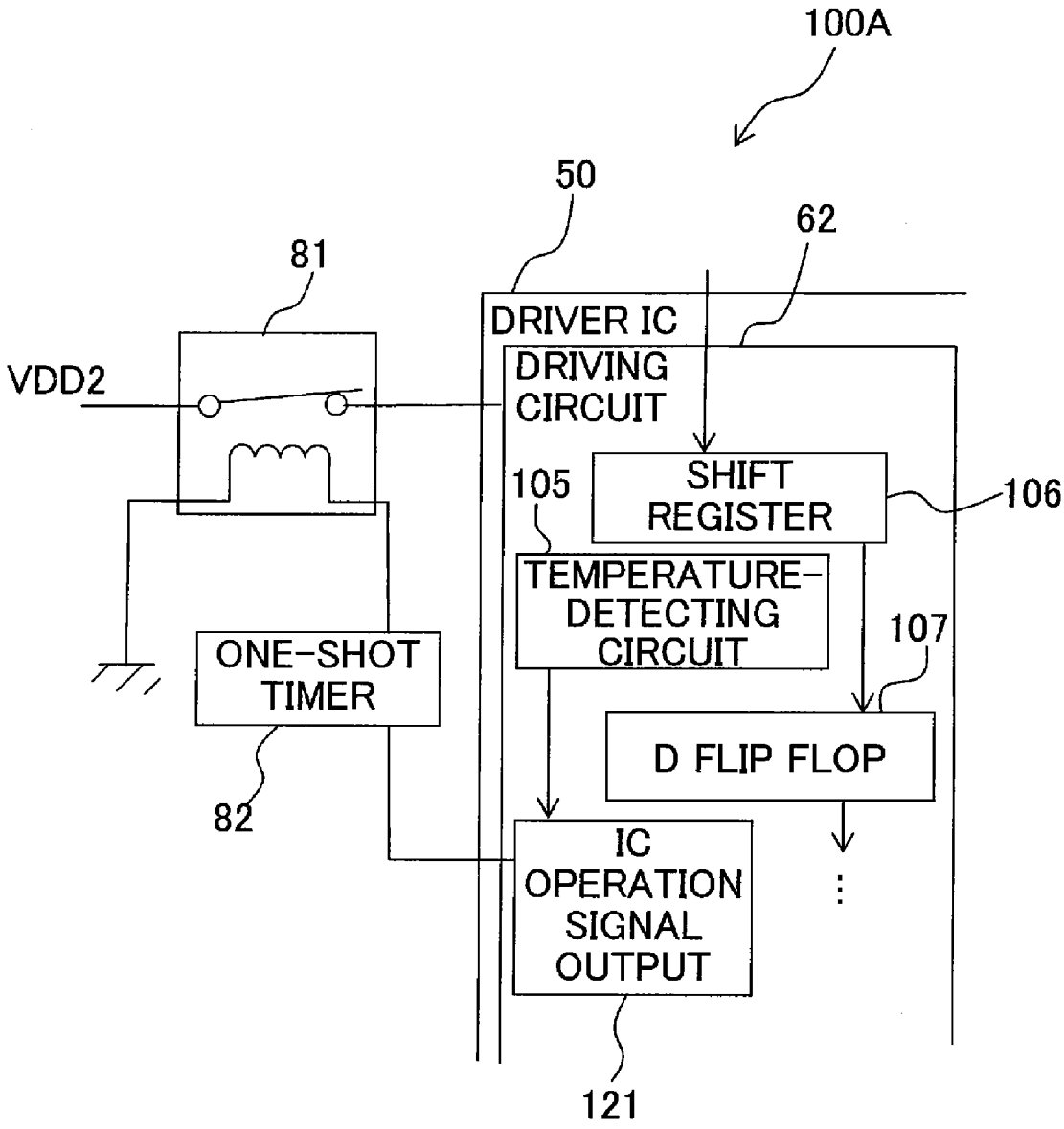
FIG. 7 shows a block diagram illustrating the relationship of connection of a driver IC, a one-shot timer, and a relay according to a second embodiment.

Next, a second embodiment will be explained. In the first embodiment, the strobe signal also serves as the IC operation signal to indicate that the driver IC 50 is in operation. On the contrary, in the second embodiment, as shown in FIG. 7, an IC operation signal output circuit 121, which outputs the IC operation signal, is provided for the control circuit 61 of the driver IC 50. Further, a temperature-detecting circuit 105 is provided to detect the temperature of the driver IC 50. An obtained result of the temperature detection is outputted to the IC operation signal output circuit 121. The shift register 106 also serves as the serial-parallel converting circuit and the strobe signal output circuit (driving instruction signal output circuit) in the same manner as in the first embodiment. Therefore, the shift register 106 is capable of generating the strobe signal (driving instruction signal) and outputting the signal to the D flip flop 107. In the second embodiment, the components or parts, which are constructed in the same manner as in the first embodiment, are omitted from the explanation, which are designated by the same reference numerals as those used in the first embodiment.

When the pulse signal as the IC operation signal, which is outputted from the IC operation signal output circuit 121, is received (when the pulse signal falls), the one-shot timer 82 continuously outputs the ON signal for a period of time Tm. When the temperature of the driver IC 50, which is detected by the temperature-detecting circuit 105, is not more than a predetermined temperature, the IC operation signal output circuit 121 outputs the pulse signal (IC operation signal) which constitutes the normal operation signal as described later on to the one-shot timer 82. When the temperature of the driver IC 50, which is detected by the temperature-detecting circuit 105, is higher than the predetermined temperature, the IC operation signal output circuit 121 outputs the pulse signal which constitutes the abnormal operation signal as described later on.

Figure 8A:
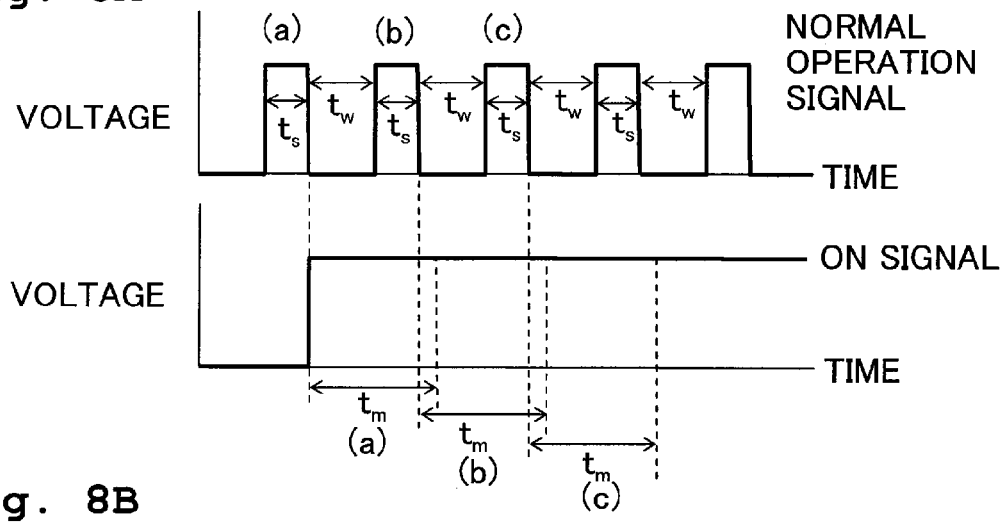
Figure 8B:
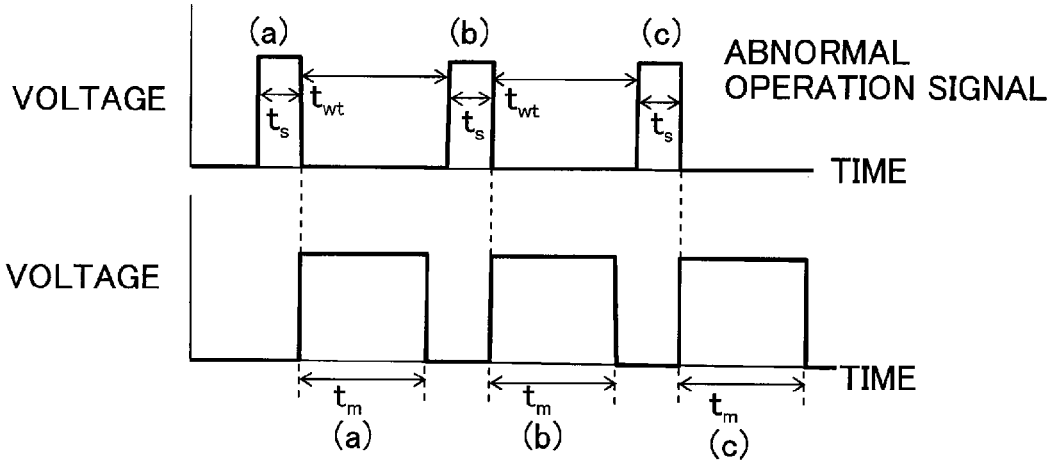
Figure 8C:
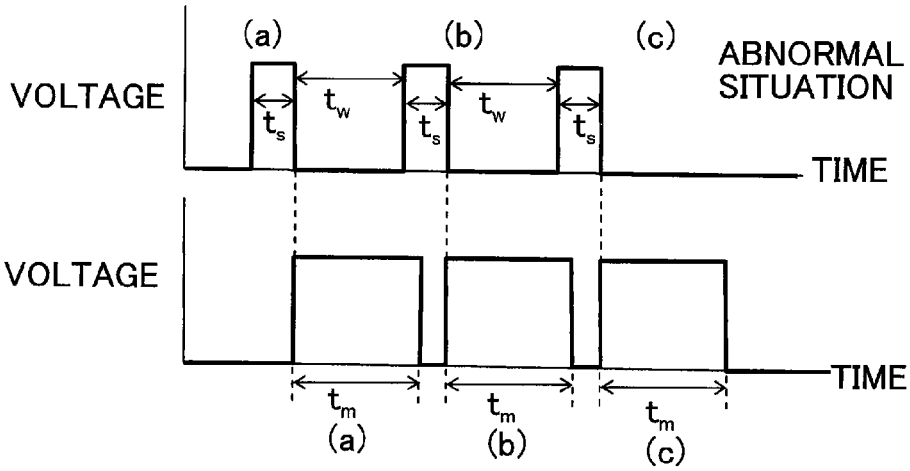

FIGS. 8A to 8C show the relationship between the normal operation signal and the abnormal operation signal outputted from the IC operation signal output circuit 121 and the ON signal outputted from the one-shot timer 82. As shown in FIG. 8A, when the driver IC 50 is operated normally, and the temperature detected by the temperature-detecting circuit 105 is not more than the predetermined temperature, then the normal operation signal, which is composed of a pulse signal having a pulse width Ts and a pulse time interval Tw, is outputted to the one-shot timer 82. When one strobe signal (s)

is received (when the pulse signal (a) falls), the one-shot timer 82 continuously outputs the ON signal (a) for the period of time Tm. In this arrangement, the output time Tm of the ON signal is not more than the total time of the pulse interval Tw and the pulse width Ts of the pulse signal (Tm≧Tw+Ts).

On the other hand, when the temperature of the driver IC 50, which is detected by the temperature-detecting circuit 105, is higher than the predetermined temperature, the IC operation signal output circuit 121 outputs the abnormal operation signal which is composed of a pulse signal having a pulse interval Twt larger than the pulse interval time Tw (with the same pulse width Ts). When the temperature of the driver IC 50 is the predetermined temperature, the pulse interval Twt of the pulse signal is the same as the time Tm during which the one-shot timer 82 continuously outputs the ON signal. The predetermined temperature is the threshold value of the temperature of the driver IC to indicate that the excess current is allowed to flow and any abnormal situation such as the heat generation arises although the operation is effected in the series of the driving operation of the driver IC 50, which is, for example, about 100 degrees C. to 120 degrees C.

FIG. 8B shows an example of the output of the abnormal operation signal. As shown in FIG. 8B, when the temperature of the driver IC 50 is higher than the predetermined temperature during the driving operation, the pulse interval of the pulse signal which constitutes the abnormal operation signal is the time Twt longer than the ON time Tm in accordance therewith. In this situation, the relationship of Tm<Twt+Ts is given. The one-shot timer 82 outputs the ON signal (a) for the predetermined period of time Tm after the pulse signal (a) is received (after the pulse signal (a) falls). The next pulse signal (b) is inputted and the next ON signal (b) is outputted after the one-shot timer 82 completes the output of the ON signal (a) (after the ON signal (a) falls). In this case, the output of the ON signal from the one-shot timer 82 is completed during the period until the next pulse signal is inputted after the pulse signal is inputted into the one-shot timer 82. In other words, when any abnormal situation arises in the driver IC 50, the pulse signal is outputted at the time interval Twt+Ts which is longer than the predetermined time Tm from the shift register 106 to the one-shot timer 82.

Therefore, the connection between the driving-pulse power supply 98 and the driving circuit 62 effected by the driving VDD2 wiring 55 is cut off by the relay 81 during the period until the next pulse signal is inputted into the one-shot timer 82 after the completion of the output of the ON signal from the one-shot timer 82. During this period, the driving electric power is not supplied from the driving-pulse power supply 98 to the driving circuit 62. In other words, the electric power is supplied intermittently.

In the example described above, as shown in FIG. 8B, the next pulse signal (b) is inputted (pulse signal (b) rises) after the ON signal (a) completely falls. On the contrary, in another example in which the abnormal operation signal is outputted, as shown in FIG. 8C, a pulse interval Twt' is provided such that the next pulse signal (b) is inputted into the one-shot timer 82 (pulse signal (b) rises) during the period in which the one-shot timer 82 outputs the ON signal (a). However, the pulse interval Twt' is such a pulse interval that the falling of the abnormal operation signal (b) comes after the falling of the ON signal (a). As described above, it is enough that the pulse interval of the pulse signal for constructing the abnormal operation signal is set so that the next ON signal (b) rises while leaving a period of time after at least the initial ON signal (a) falls.

When the pulse signal is not outputted, the ON signal is not outputted from the one-shot timer 82 to the relay 81. The connection between the driving-pulse power supply 98 and the driving circuit 62, which is effected by the driving VDD2 wiring 55, is cut off.

As described above, in the second embodiment, when the temperature is higher than the predetermined temperature due to the occurrence of the abnormality although the driver IC 50 is operated, the driving electric power is intermittently supplied to the driving circuit 62. It is possible to confirm the fact that the temperature of the driver IC 50 is higher than the predetermined temperature, i.e., the temperature at which any abnormal situation arises. Further, it is possible to suppress any excessive increase in the temperature of the driver IC 50, and it is possible to avoid the ignition and the destruction of the driver IC 50, for example, by previously lowering or temporarily shutting off the electric power to be supplied from the driving-pulse power supply 98 to the driving circuit 62. When the pulse signal is not outputted when the driver IC 50 is in any abnormal situation, it is possible to completely cut off the electric power supply.

The driving electric power is intermittently supplied from the driving-pulse power supply 98 to the driving circuit 62, or the electric power supply is completely cut off. Therefore, the main body of the liquid droplet discharge apparatus is in such a state that no ink is discharged from the ink-jet head 3. It is possible to confirm the occurrence of any abnormality. For example, when a monitoring circuit and/or a display circuit, which is capable of displaying the error, for example, on a display panel of the liquid droplet discharge apparatus, is provided beforehand, it is possible to output the cause of the error as well. When the intermittent (pulse-shaped) ON signal is outputted from the one-shot timer 82 as shown in FIGS. 8B and 8C, the relay 81 is also driven intermittently. In conformity therewith, the driving-pulse power supply 98 and the driving circuit 62 are connected intermittently as well. In this situation, the voltage, which is actually applied to the driving circuit 62, follows the ON signal at a predetermined time constant. In other words, the waveform of the voltage actually applied to the driving circuit 62 is not the rectangular waveform as illustrated as the ON signal in FIGS. 8B and 8C. The waveform is equivalent to the voltage waveform of a capacitor in which the electric charge and discharge are repeated at a predetermined time constant. In this case, when the cycle of the ON signal is relatively short, the applied voltage is cut off before the voltage to be actually applied to the driving circuit 62 arrives at the voltage of the driving-pulse power supply 98. As a result, the voltage, which is lower than the voltage of the driving-pulse power supply 98, is applied to the driving circuit 62. In this case, it is possible to suppress the electric power supplied to the driving circuit 62. Therefore, it is possible to suppress the excessive increase in the temperature of the driver IC 50, and it is possible to avoid the ignition and the destruction of the driver IC 50.

In the first and second embodiments, the voltage (for example, 16 V), which is applied from the driving-pulse power supply 98 to the driving circuit 62, is higher than the voltage (for example, 5 V) which is applied from the control-signal power supply 97 to the control circuit 61. When any abnormal situation arises in the driver IC 50, the temperature of the driver IC 50 tends to increase in the state in which the driver IC 50 is connected to the driving-pulse power supply 98 as compared with the state in which the driver IC 50 is connected to the control-signal power supply 97. Therefore, in the embodiment of the present invention, the excessive increase in the temperature of the driver IC 50 and the ignition of the driver IC 50 are reliably avoided by providing the relay 82 not at any intermediate position of the driving VDD1 wiring 57 connecting the control-signal power supply 97 and the control circuit 61, but at the intermediate position of the driving VDD2 wiring 55 connecting the driving-pulse power supply 98 and the driving circuit 62.

According to the first and second embodiments explained above, when the driver IC 50 is operated normally, the relationship of $Tw+Ts \leqq Tm$ holds between the output time Tm of the ON signal and the pulse interval Tw and the pulse time Ts of the pulse signal for constructing the normal operation signal. The pulse signal is outputted at the time not more than the predetermined time Tm, and the next strobe signal is inputted into the one-shot timer 82 before one-shot timer 82 completes the output of the ON signal. Therefore, the ON signal is always outputted continuously from the one-shot timer 82 to the relay 81. Therefore, the driving-pulse power supply 98 and the driving circuit 62 are kept being connected to one another. The voltage is continuously applied to the driver IC 50 from the driving-pulse power supply 98.

When any abnormal situation arises in the driver IC 50, and the pulse signal is not outputted from the shift register 106, then the next ON signal is not outputted from the one-shot timer 82 to the relay 81 after the time Tm elapses after the pulse signal, which is finally inputted into the one-shot timer 82, falls. The connection between the driving-pulse power supply 98 and the driving circuit 62 is cut off. Therefore, the electric power is not supplied from the driving-pulse power supply 98 to the driver IC 50. It is possible to avoid the excessive increase in the temperature of the driver IC 50, and it is possible to avoid the ignition of the driver IC 50.

The temperature-detecting circuit 105 is provided for the driver IC 50. The relationship of $Twt+Ts>Tm$ holds between the output time Tm of the ON signal of the one-shot timer and the pulse interval Twt and the pulse time Ts of the pulse signal for constructing the abnormal operation signal to be inputted into the one-shot timer 82 when the temperature is higher than the predetermined temperature due to any abnormal situation in the driver IC 50 although the driver IC 50 is operated. Therefore, the output of the ON signal is completed during the period until the next pulse signal falls after the pulse signal inputted into the one-shot timer 82 falls. Therefore, the connection between the driving-pulse power supply 98 and the driving circuit 62 is cut off during the period until the next pulse signal is inputted after the completion of the output of the ON signal. Therefore, it is possible to confirm the fact that the high temperature is brought about, for example, due to the occurrence of any abnormal situation in the driver IC 50. Further, it is possible to avoid the ignition and the destruction caused by the driver IC 50 by previously suppressing the excessive increase in the temperature of the driver IC 50 by lowering or temporarily stopping the electric power to be supplied from the driving-pulse power supply 98 to the driver IC 50.

The relatively high voltage is applied to the driver IC 50 by the driving-pulse power supply 98. Therefore, the temperature of the driver IC 50 tends to increase. However, when any abnormal situation arises in the driver IC 50, the connection between the driving-pulse power supply 98 and the driving circuit 62 is cut off. Therefore, it is possible to reliably avoid the excessive increase in the temperature of the driver IC 50 and the ignition of the driver IC 50.

Next an explanation will be made about modified embodiments in which various changes are applied to the first and second embodiments. However, the components or parts, which are constructed in the same manner as in the first and second embodiments, are designated by the same reference numerals, any explanation of which will be appropriately omitted.

Figure 9:
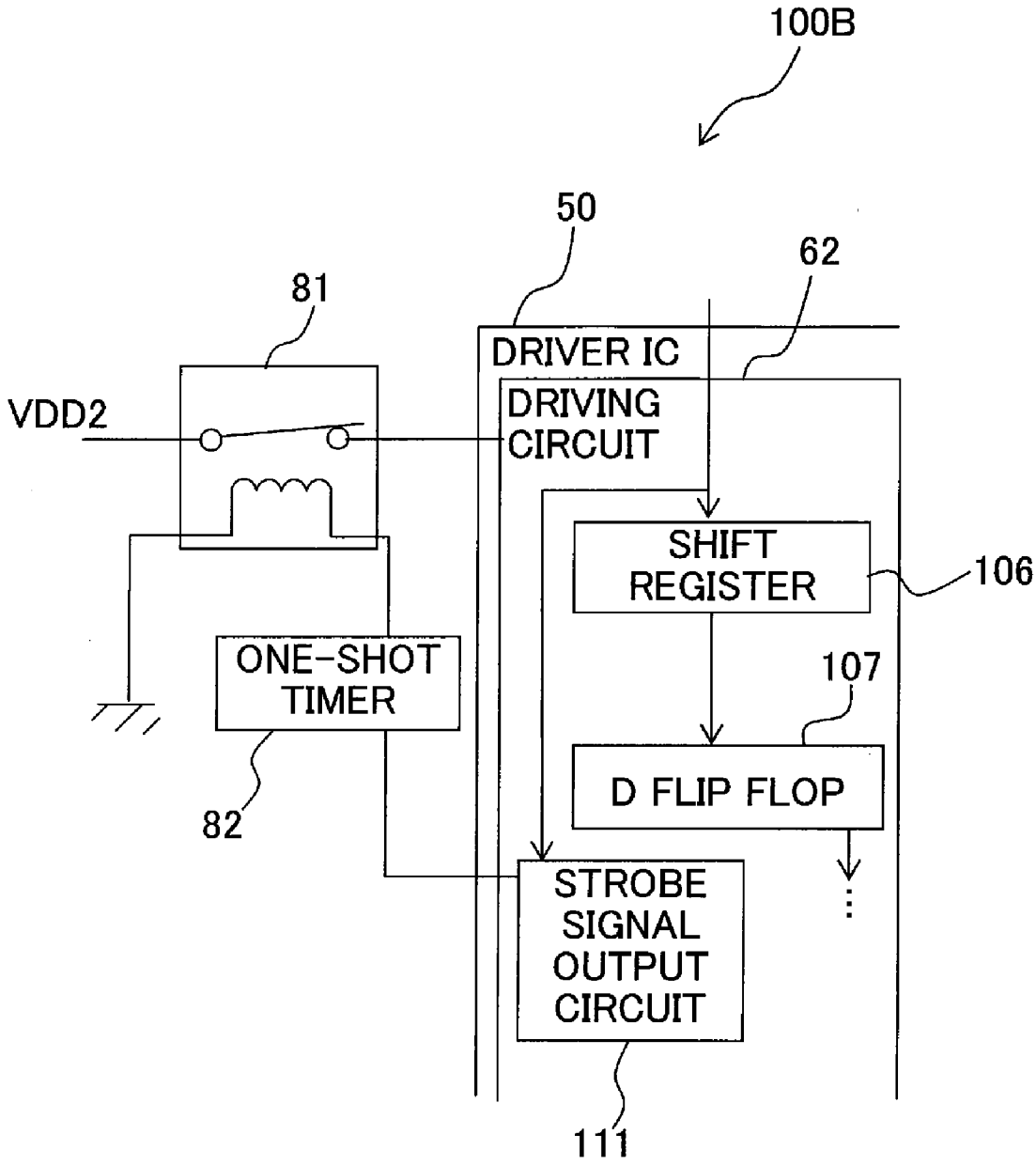
FIG. 9 shows a first modified embodiment corresponding to FIG. 5.

The first modified embodiment is a modified embodiment of the first embodiment. As shown in FIG. 9, the driving circuit 62 of the driver IC 50 is provided with a strobe signal output circuit 111. In other words, the shift register 106 functions as the serial-parallel converting circuit. The strobe signal output circuit (driving instruction signal output circuit) 111 and the serial-parallel converting circuit are provided independently. When the signal of the printing data of each of the channels (driving signal instruction data indicating the type of the driving signal) is inputted as the serial signal from the signal line of the data signal into the shift register 106, the shift register 106 performs the serial-parallel conversion of the serial signal, and the obtained signal is outputted to the D flip flop 107. When the signal, which indicates that the input of the printing data into the shift register 106 is completed, is inputted, the strobe signal output circuit 111 outputs the strobe signal (driving instruction signal) to the D flip flop 107.

It is also allowable that the signal, which indicates that the printing data corresponding to all of the channels is inputted, is not inputted into the shift register 106 unlike the first embodiment. It is also allowable that the strobe signal output circuit 111 is constructed such that the strobe signal is outputted to the D flip flop 107 and the one-shot timer 82 when the printing data of all of the channels is inputted into the shift register 106.

Even in the case of the first modified embodiment, it is possible to avoid the excessive increase in the temperature in the driver IC 50 and the ignition of the driver IC in the same manner as in the first embodiment. The strobe signal output circuit 111 in the first modified embodiment serves as both of the driving instruction signal output circuit and the IC operation signal output circuit according to the present invention. The strobe signal is used as the normal operation signal indicating that the driver IC 50 is operated normally as in the first embodiment. Therefore, it is unnecessary to distinctly provide any circuit for outputting the normal operation signal. It is possible to miniaturize the driver IC 50.

Figure 10:
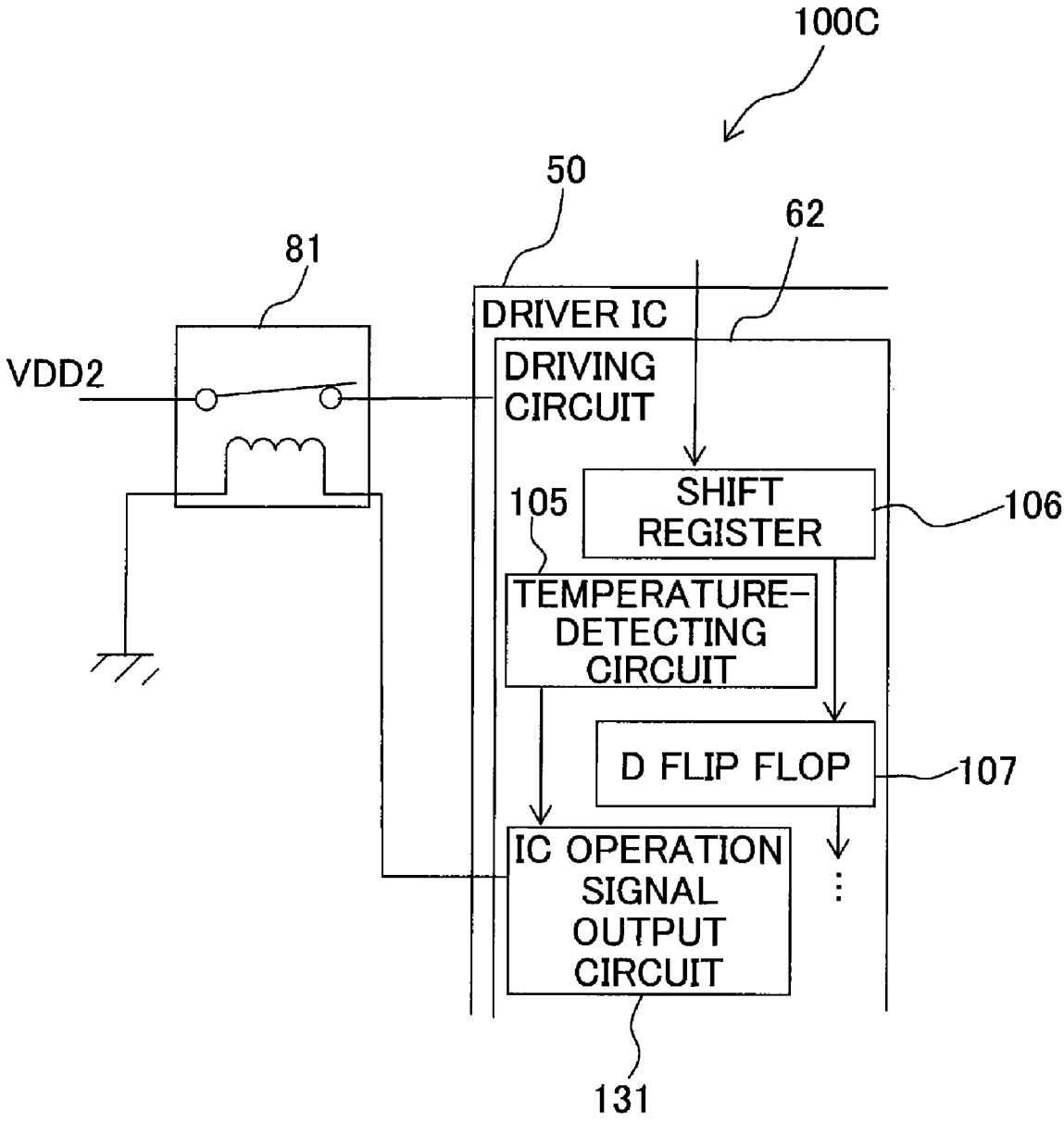
FIG. 10 shows a second modified embodiment corresponding to FIG. 5.

In the foregoing description, the IC operation signal, which indicates that the driver IC 50 is in operation, is the pulse signal. However, there is no limitation thereto. For example, in the second modified embodiment described below, as shown in FIG. 10, the one-shot timer is not provided unlike the first and second embodiments. The driver IC 50 further comprises an IC operation signal output circuit 131 which outputs the operation signal to indicate that the driver IC 50 is operated. The IC operation signal output circuit 131 continuously outputs, as the normal operation signal to the relay 81, the constant voltage signal (IC operation signal) indicating that the driver IC 50 is operated when the temperature of the driver IC 50, which is detected by the temperature-detecting circuit 105, is not more than the predetermined temperature (when the driver IC 50 is operated normally). When the temperature of the driver IC 50, which is detected by the temperature-detecting circuit 105, is higher than the predetermined temperature (when any abnormal situation arises in the driver IC 50), the IC operation signal as described above is not outputted.

In this case, the relay 81 keeps the driving-pulse power supply 98 and the driving device 62 (driver IC 50) connecting to one another by means of the driving VDD2 wiring 55 during the period in which the constant voltage signal, which is the IC operation signal for constructing the normal operation signal, is inputted. The driving electric power is continuously supplied from the driving-pulse power supply 98 to the driving device 62. However, when the IC operation signal is not inputted, the relay 81 cuts off the connection between the driving-pulse power supply 98 and the driving circuit 62 having been effected by the driving VDD2 wiring 55. Accordingly, the driving electric power is not supplied from the driving-pulse power supply 98 to the driving device 62. Therefore, it is possible to avoid the excessive increase in the temperature of the driver IC 50 and the ignition of the driver IC 50.

In the embodiment of the present invention, the relay 81 and the one-shot timer 82 for controlling the switching of the relay 81 are provided at the intermediate positions of the driving VDD2 wiring 55. However, it is also allowable that a similar relay and a one-shot timer for controlling the switching operation of the relay are further provided at intermediate positions of the driving VDD1 wiring 57.

The voltage, which is applied from the control-signal power supply 97 to the control circuit 61 (driver IC 50), is the relatively low voltage. However, when any abnormal situation arises in the driver IC 50, then the temperature of the driver IC 50 may be excessively raised and/or the driver IC 50 may be ignited due to the voltage applied by the control-signal power supply 97. Even in such a situation, it is possible to reliably avoid the excessive increase in the temperature of the driver IC and the ignition of the driver IC 50 such that a similar relay and a similar one-shot timer are also provided at intermediate positions of the driving VDD1 wiring 57 as well, and the connection between the control-signal power supply 97 and the control circuit 61 effected by the driving VDD1 wiring 57 is cut off when any abnormal situation arises in the driver IC 50.

In the embodiment of the present invention, the present invention is applied to the driver IC 50 which drives the ink-jet head 3. However, the present invention is also applicable to any driver IC which drives any driving objective other than the ink-jet head. The present invention is also applicable to any IC (logic IC) for performing the calculation, the IC (logic IC) being distinct from the driver IC.

What is claimed is:

1. An electric power supply cut-off circuit which cuts off an electric power supplied from a power source, the electric power supply cut-off circuit comprising:

an IC having an IC operation signal output circuit which outputs an IC operation signal indicating that the IC is in operation, which outputs a normal operation signal when the IC is operated normally, and which does not output the IC operation signal or outputs an abnormal operation signal when any abnormal situation arises in the IC, the normal operation signal being composed of the IC operation signal and indicating that the IC is operated normally, and the abnormal operation signal having a waveform different from that of the normal operation signal;

a switch which makes a switching operation between the IC and the power source; and a switching control circuit which controls the switching operation of the switch and which continuously outputs, to the switch, a connection instruction signal to instruct a connection between the IC and the power source during a period in which the normal operation signal is inputted from the IC operation signal output circuit;

wherein the switch makes the connection between the IC and the power source when the connection instruction signal is inputted to the switch, and the switch cuts off the connection between the IC and the power source when the connection instruction signal is not inputted to the switch, when the IC operation signal is inputted, the switching control circuit outputs the connection instruction signal to the switch only for a predetermined period of time; and when the IC is operated normally, the IC operation signal output circuit outputs, to the switching control circuit, the IC operation signal as the normal operation signal at a time interval which is not more than the predetermined period of time, and when the abnormal situation arises in the IC, the IC operation signal output circuit outputs, to the switching control circuit, the IC operation signal as the abnormal operation signal at a time interval which is longer than the predetermined period of time.

2. The electric power supply cut-off circuit according to claim 1, wherein the IC further includes a temperature-detecting section which detects a temperature of the IC;

the IC operation signal output circuit outputs a pulse signal as the IC operation signal to the switching control circuit at a time interval which corresponds to the temperature detected by the temperature-detecting section;

the IC operation signal output circuit outputs, when the temperature detected by the temperature-detecting section is not more than a predetermined temperature, the pulse signal as the normal operation signal to the switching control circuit at a time interval which is not more than the predetermined period of time; and the IC operation signal output circuit outputs, when the temperature detected by the temperature-detecting section is higher than the predetermined temperature, the pulse signal as the abnormal operation signal to the switching control circuit at a time interval which is longer than the predetermined period of time.

3. The electric power supply cut-off circuit according to claim 1, wherein the IC is a driver IC which drives a driving objective.

4. The electric power supply cut-off circuit according to claim 3, wherein the driver IC has a driving signal output circuit which outputs, to the driving objective, a driving signal for driving the driving objective; and the normal operation signal is outputted in synchronization with the driving signal.

5. The electric power supply cut-off circuit according to claim 3, wherein the driving objective has a plurality of driving elements, and the driver IC includes:

a driving signal output circuit which outputs, to the plurality of driving elements, driving signals for driving the plurality of driving elements;

a serial-parallel converting circuit into which a plurality of pieces of driving signal instruction data indicating types of the driving signals to be outputted to the plurality of driving elements are inputted as serial signals and which outputs the plurality of pieces of the inputted driving signal instruction data as parallel signals corresponding to the plurality of driving elements;

a latch circuit which retains the driving signal instruction data as the parallel signals outputted from the serial-parallel converting circuit and which outputs the retained driving signal instruction data to the driving signal output circuit; and a driving instruction signal output circuit which outputs, to the latch circuit, a driving instruction signal instructing the driving signal output circuit to output the plurality of pieces of the driving signal instruction data retained by the latch circuit;

wherein the driving signal output circuit outputs, corresponding to the driving elements, the driving signal indicated by the inputted driving signal instruction data when the driving signal instruction data is inputted; and the driving instruction signal output circuit outputs the driving instruction signal when all of the plurality of pieces of the driving signal instruction data, corresponding to the driving elements, respectively, are retained by the latch circuit.

6. The electric power supply cut-off circuit according to claim 5, wherein the driving instruction signal output circuit outputs the driving instruction signal to the latch circuit, and the driving instruction signal output circuit serves also as the IC operation signal output circuit, and outputs the driving instruction signal as the IC operation signal to the switching control circuit.

7. A liquid droplet discharge apparatus which discharges liquid droplets, the liquid droplet discharge apparatus comprising:

a liquid droplet discharge head;

a driver IC which drives the liquid droplet discharge head, the driver IC including an IC operation signal output circuit which outputs an IC operation signal indicating that the IC is in operation, which outputs a normal operation signal when the driver IC is operated normally, and which does not output the IC operation signal or outputs an abnormal operation signal when any abnormal situation arises in the driver IC, the normal operation signal being composed of the IC operation signal and indicating that the driver IC is operated normally, and the abnormal operation signal having a waveform different from that of the normal operation signal;

a power source which supplies an electric power to the driver IC;

a switch which makes a switching operation between the driver IC and the power source; and a switching control circuit which receives the IC operation signal and controls the switching operation of the switch and which continuously outputs, to the switch, a connection instruction signal to instruct a connection between the driver IC and the power source during a period in which the normal operation signal is inputted, wherein the switch makes the connection between the driver IC and the power source when the connection instruction signal is inputted to the switch, and the switch cuts off the connection between the driver IC and the power source when the connection instruction signal is not inputted to the switch, when the driver IC operation signal is inputted, the switching control circuit outputs the connection instruction signal to the switch only for a predetermined period of time; and when the driver IC is operated normally, the IC operation signal output circuit outputs, to the switching control circuit, the IC operation signal as the normal operation signal at a time interval which is not more than the predetermined period of time, and when the abnormal situation arises in the driver IC, the IC operation signal output circuit outputs, to the switching control circuit, the IC operation signal as the abnormal operation signal at a time interval which is longer than the predetermined period of time.

8. The liquid droplet discharge apparatus according to claim 7, wherein the IC further includes a temperature-detecting section which detects a temperature of the IC;

the IC operation signal output circuit outputs a pulse signal as the IC operation signal to the switching control circuit at a time interval which corresponds to the temperature detected by the temperature-detecting section;

the IC operation signal output circuit outputs, when the temperature detected by the temperature-detecting section is not more than a predetermined temperature, the pulse signal as the normal operation signal to the switching control circuit at a time interval which is not more than the predetermined period time; and the IC operation signal output circuit outputs, when the temperature detected by the temperature-detecting section is higher than the predetermined temperature, the pulse signal as the abnormal operation signal to the switching control circuit at a time interval which is longer than the predetermined period time.

9. The liquid droplet discharge apparatus according to claim 7, wherein the driver IC has a driving signal output circuit which outputs, to the liquid droplet discharge head, a driving signal for driving the liquid droplet discharge head, and the IC operation signal output circuit outputs the normal operation signal in synchronization with the driving signal.

* * * * *